US009162492B2

(12) United States Patent
Iijima

(10) Patent No.: US 9,162,492 B2
(45) Date of Patent: Oct. 20, 2015

(54) INKJET RECORDING APPARATUS

(71) Applicant: Shota Iijima, Nagoya (JP)

(72) Inventor: Shota Iijima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/569,415

(22) Filed: Dec. 12, 2014

(65) Prior Publication Data

US 2015/0097905 A1 Apr. 9, 2015

Related U.S. Application Data

(62) Division of application No. 14/014,648, filed on Aug. 30, 2013, now Pat. No. 8,911,053.

(30) Foreign Application Priority Data

Aug. 31, 2012 (JP) ..... 2012-192624

(51) Int. Cl.

| | |
|---|---|
| ***B41J 2/01*** | (2006.01) |
| ***B41J 29/38*** | (2006.01) |
| ***B41J 11/04*** | (2006.01) |
| ***B41J 13/00*** | (2006.01) |
| ***B41J 3/60*** | (2006.01) |
| ***B65H 3/06*** | (2006.01) |
| ***B65H 5/06*** | (2006.01) |
| ***B65H 9/00*** | (2006.01) |
| ***B65H 29/70*** | (2006.01) |

(52) U.S. Cl.

CPC .. *B41J 11/04* (2013.01); *B41J 3/60* (2013.01); *B41J 13/0009* (2013.01); *B65H 3/0676* (2013.01); *B65H 5/068* (2013.01); *B65H 9/002* (2013.01); *B65H 29/70* (2013.01)

(58) Field of Classification Search

CPC ..... B41J 3/60; B41J 13/10; B41J 3/02; B41J 3/009; B41J 13/0009; B41J 11/04

USPC ..... 347/14, 16, 101, 104

See application file for complete search history.

(56) References Cited

U.S. PATENT DOCUMENTS

| | | | |
|---|---|---|---|
| 5,689,793 | A | 11/1997 | Kobayashi et al. |
| 5,819,152 | A | 10/1998 | Kobayashi et al. |
| 2009/0218754 | A1 | 9/2009 | Sugiyama et al. |
| 2010/0244357 | A1 | 9/2010 | Takahata |
| 2012/0113204 | A1 | 5/2012 | Tanaka et al. |

FOREIGN PATENT DOCUMENTS

| | | | |
|---|---|---|---|
| JP | H08-133551 | A | 5/1996 |
| JP | 2001-225995 | A | 8/2001 |
| JP | 2009-208862 | A | 9/2009 |

*Primary Examiner* — Jannelle M Lebron

(74) *Attorney, Agent, or Firm* — Baker Botts L.L.P.

(57) ABSTRACT

An inkjet recording apparatus configured to record images on both sides of a sheet includes a corrugate mechanism configured to form a sheet into a continuous corrugated shaped in a direction perpendicular to a conveyance direction and parallel to a recording surface of the sheet.

8 Claims, 10 Drawing Sheets

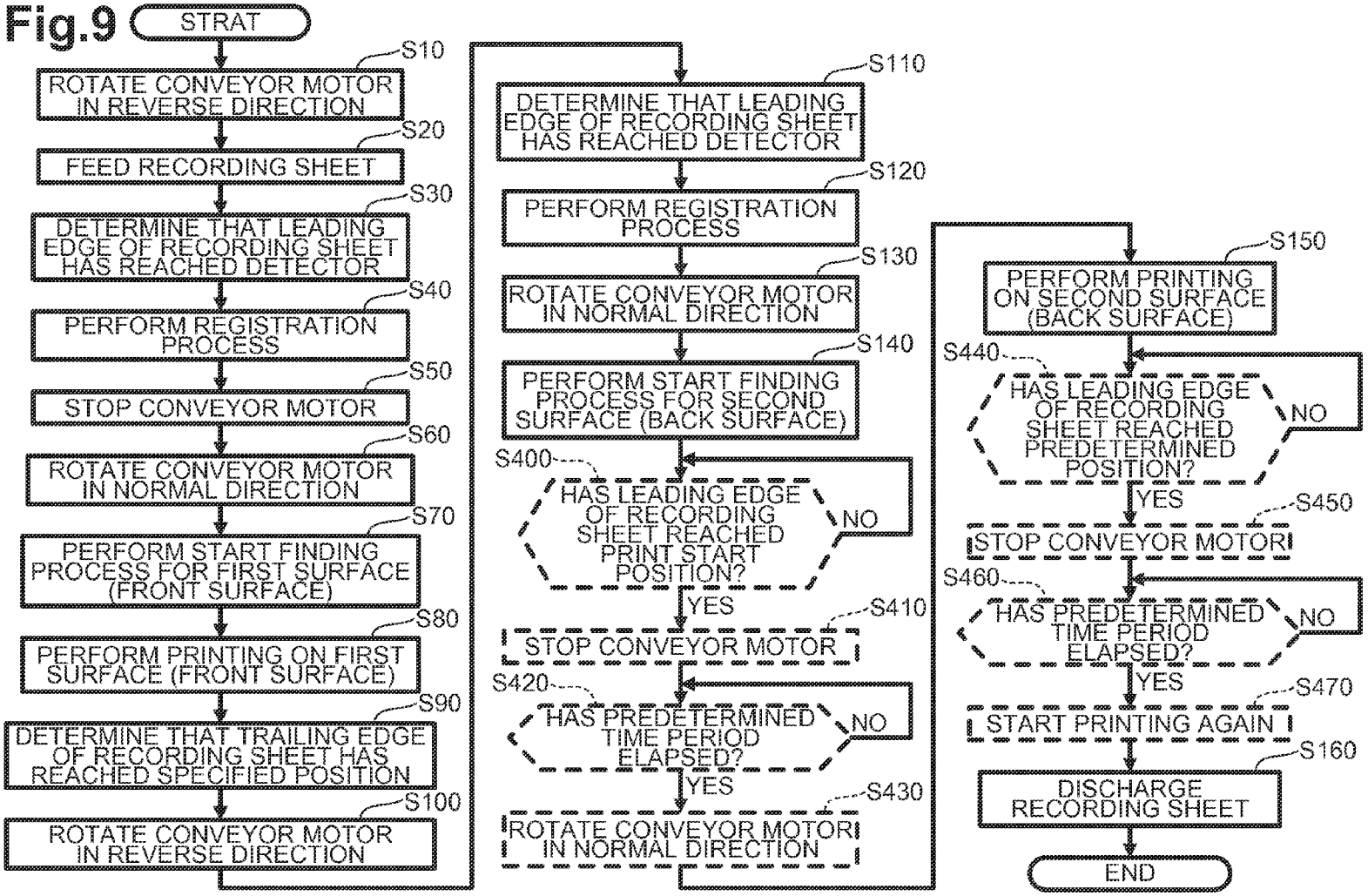
Fig.9
STRAT
S10
ROTATE CONVEYOR MOTOR IN REVERSE DIRECTION
S20
FEED RECORDING SHEET
S30
DETERMINE THAT LEADING EDGE OF RECORDING SHEET HAS REACHED DETECTOR
S40
PERFORM REGISTRATION PROCESS
S50
STOP CONVEYOR MOTOR
S60
ROTATE CONVEYOR MOTOR IN NORMAL DIRECTION
S70
PERFORM START FINDING PROCESS FOR FIRST SURFACE (FRONT SURFACE)
S80
PERFORM PRINTING ON FIRST SURFACE (FRONT SURFACE)
S90
DETERMINE THAT TRAILING EDGE OF RECORDING SHEET HAS REACHED SPECIFIED POSITION
S100
ROTATE CONVEYOR MOTOR IN REVERSE DIRECTION
S110
DETERMINE THAT LEADING EDGE OF RECORDING SHEET HAS REACHED DETECTOR
S120
PERFORM REGISTRATION PROCESS
S130
ROTATE CONVEYOR MOTOR IN NORMAL DIRECTION
S140
PERFORM START FINDING PROCESS FOR SECOND SURFACE (BACK SURFACE)
S400
HAS LEADING EDGE OF RECORDING SHEET REACHED PRINT START POSITION?
NO
YES
S410
STOP CONVEYOR MOTOR
S420
HAS PREDETERMINED TIME PERIOD ELAPSED?
NO
YES
S430
ROTATE CONVEYOR MOTOR IN NORMAL DIRECTION
S150
PERFORM PRINTING ON SECOND SURFACE (BACK SURFACE)
S440
HAS LEADING EDGE OF RECORDING SHEET REACHED PREDETERMINED POSITION?
NO
YES
S450
STOP CONVEYOR MOTOR
S460
HAS PREDETERMINED TIME PERIOD ELAPSED?
NO
YES
S470
START PRINTING AGAIN
S160
DISCHARGE RECORDING SHEET
END

INKJET RECORDING APPARATUS

CROSS-REFERENCE TO RELATED APPLICATION

This application is a divisional of U.S. patent application Ser. No. 14/014,648, filed on Aug. 30,2013, which claims priority from Japanese Patent Application No. 2012-192624, filed on Aug. 31, 2012,the disclosures of which are incorporated herein by reference in their entirety.

BACKGROUND OF THE DISCLOSURE

1. Field of the Disclosure

The disclosure relates generally to an inkjet recording apparatus that records an image onto a sheet by ejecting ink droplets from nozzles, and more particularly, to an inkjet recording apparatus that is capable of recording images on both surfaces of a sheet.

2. Description of Related Art

Known inkjet recording apparatuses are capable of recording an image onto a sheet by ejecting ink droplets from nozzles.

In recent years, there has been an increase in the number of inkjet recording apparatuses that are capable of recording images on both surfaces of a sheet. In an example of such an inkjet recording apparatus, a sheet fed from a feed tray is conveyed to a recording unit by a conveyor roller pair. In the recording unit, an image is recorded on one surface of the sheet. The sheet is then turned back by a reversible roller pair at a position downstream of the recording unit and conveyed into a refeed conveyance path that is disposed below the recording unit and above the feed tray. The sheet conveyed into the refeed conveyance path is then conveyed to the conveyor roller pair again via the refeed conveyance path. After that, an image is recorded, via the recording unit, on the other surface of the recording sheet that has reached the recording unit by the conveyor roller pair, in a similar manner to the manner in which the image is recorded on the one surface of the sheet. Thereafter, the sheet having the images recorded on both surfaces is discharged onto a discharge tray by the reversible roller pair.

SUMMARY OF THE INVENTION

In recent years, on one hand, a reduction in the size of an inkjet recording apparatus may be demanded, and on the other hand, an inkjet recording apparatus may be required to be able to record an image onto a sheet having a size as large as possible. In an inkjet recording apparatus that may satisfy both the requirements described above, the following situation may occur. That is, after an image is recorded on one surface of a sheet, the sheet may be turned back by the reversible roller pair and may be conveyed to the conveyor roller pair again via the refeed conveyance path. Then, an image may be recorded on the other surface of the sheet. When a leading edge of the sheet having the recorded images reaches the reversible roller pair again, a trailing edge portion of the sheet may not yet be released from the reversible roller pair, that is, may be still nipped by the reversible roller pair, when the size of the sheet is relatively large.

In the inkjet recording apparatus, when ink droplets are ejected onto the sheet by the recording unit, ink droplets may be absorbed in the sheet and thus the sheet may be deformed or warped. As a result, it may be difficult to guide the leading edge of the deformed sheet to the reversible roller pair.

The present invention may provide an inkjet recording apparatus in which a leading edge of a sheet is guided to a reversible roller pair that is nipping a trailing edge portion of the sheet and the reversible roller pair may pinch the sheet appropriately.

According to an embodiment of the invention, an inkjet recording apparatus may comprise a conveyor roller pair, a recording unit, a reversible roller pair, a corrugate mechanism, and a control device. The conveyor roller pair may comprise a plurality of rollers and configured to convey a sheet, which is being guided in a first conveyance path, along a conveyance direction while nipping the sheet therebetween. Each of the plurality of rollers may comprise a rotational shaft. The recording unit may be disposed downstream of the conveyor roller pair in the conveyance direction and configured to eject ink droplets from nozzles to record an image onto the sheet. The reversible roller pair may be disposed downstream of the conveyor roller pair in the conveyance direction and configured to convey the sheet downstream in the conveyance direction or into a second conveyance path while nipping the sheet therebetween. The second conveyance path may join the first conveyance path at a first junction located downstream of the conveyor roller pair and upstream of the reversible roller pair in the conveyance direction and at a second junction located upstream of the conveyor roller pair in the conveyance direction. The corrugate mechanism may be disposed upstream of the reversible roller pair in the conveyance direction and configured to form the sheet into a corrugated shape in a direction perpendicular to the conveyance direction and parallel to a recording surface of the sheet. The control device may be configured to record an image on a first surface of the sheet by the recording unit. A sheet length along the conveyance direction of the sheet may be longer than a length of a conveyance path that starts at a nip point of the reversible roller pair, extends through the second conveyance path from the nip point to the conveyor roller pair and further through the first conveyance path from the conveyor roller pair to the nip point, and returns to the same nip point. The control device may be further configured to convey, via the reversible roller pair, toward the second conveyance path, the sheet in which the image is recorded on the first surface, and record an image on a second surface of the sheet via the recording unit. The second surface may be opposite to the first surface. The control device may be further configured to convey the sheet by the conveyor roller pair such that a leading edge of the sheet passes the reversible roller pair and reaches a position downstream of the reversible roller pair in the conveyance direction.

According to the aspects of the invention, the leading edge of the sheet may be guided to the reversible roller pair that nips the trailing edge portion of the sheet and the reversible roller pair may pinch the sheet appropriately.

According to an embodiment of the invention, an inkjet recording apparatus may comprise a recording unit, a sheet-supply roller, a first roller pair, a second roller pair, and a corrugate mechanism. The recording unit may be configured to eject ink droplets from nozzles to record an image onto a sheet. The sheet-supply roller may be configured to supply and convey a sheet along a conveyance direction. The first roller pair may be disposed between the recording unit and the sheet supply roller along the conveyance direction, and may be configured to convey the sheet to the recording unit alone the conveyance direction at a first conveyance force while nipping the sheet therebetween at a first nip point. The second roller pair may be disposed downstream of the first roller pair in the conveyance direction, and may be configured to return back a single-side image recorded sheet to the first roller pair at a second conveyance force less than the first conveyance force while nipping the sheet therebetween at a second nip point without passing through the sheet-supply roller. The corrugate mechanism may be disposed between the first roller pair and the second roller pair, and may be configured to form the sheet into a corrugated shape in a direction perpendicular to the conveyance direction and parallel to a recording surface of the sheet Other objects, features, and advantages will be apparent to persons of ordinary skill in the art from the following detailed description of the invention and the accompanying drawings.

BRIEF DESCRIPTION OF THE DRAWINGS

For a more complete understanding of the present disclosure, needs satisfied thereby, and the objects, features, and advantages thereof, reference now is made to the following descriptions taken in connection with the accompanying drawings.

FIG. 9 is a flowchart depicting an example procedure of a process performed by the microcomputer to perform double-sided image recording on a recording sheet according to another embodiment of the invention.

DETAILED DESCRIPTION OF EMBODIMENTS OF INVENTION

Figure 1:
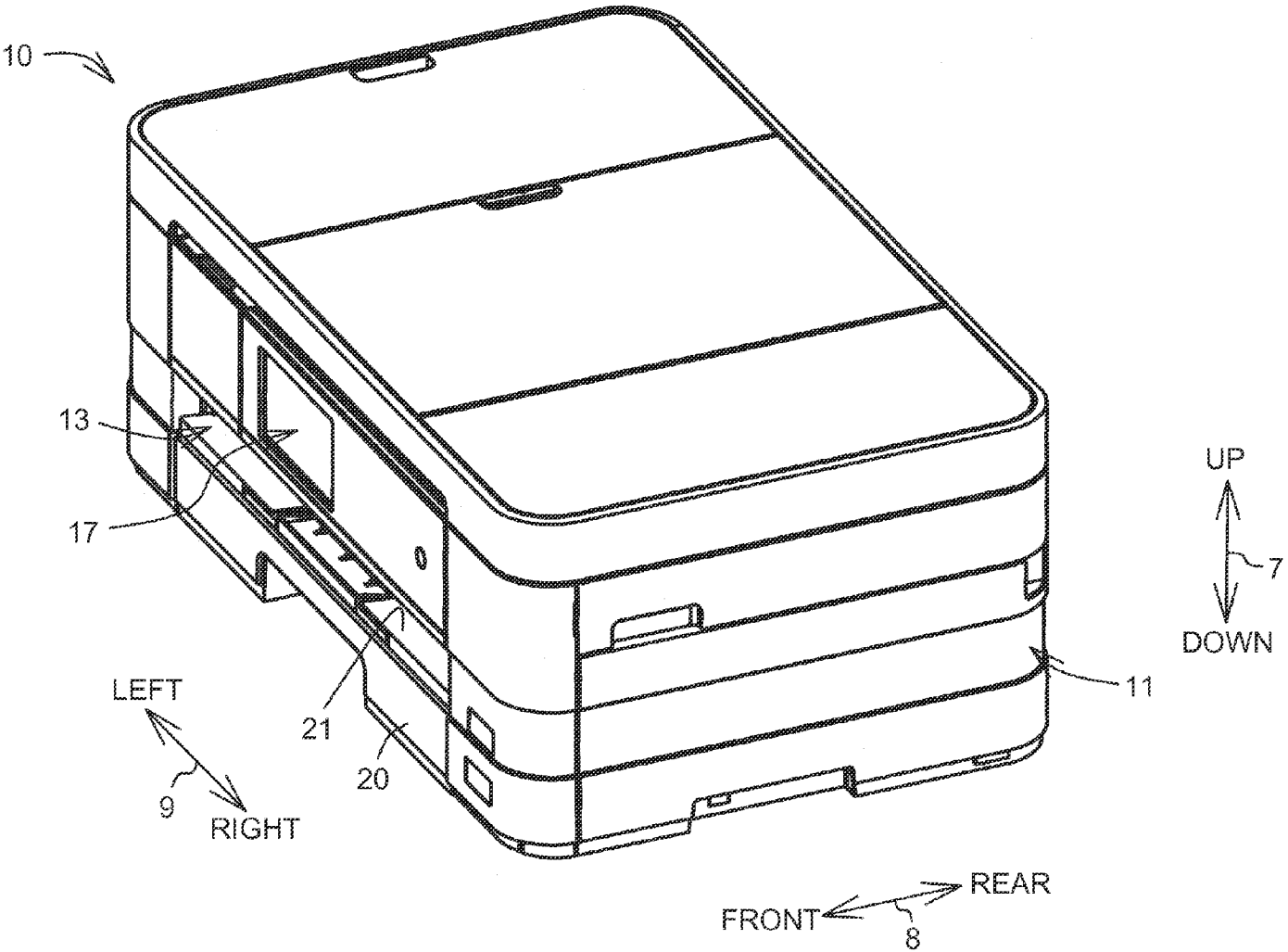
FIG. 1 is a perspective view depicting a multifunction device according to an embodiment of the invention.

An embodiment according to one or more aspects is described below with reference to the accompanying drawings. The embodiment described below is merely an example. Various changes, arrangements and modifications may be applied therein without departing from the spirit and scope of the invention. In the description below, an up-down direction 7 may be defined with reference to an orientation of a multifunction device 10 that may be disposed in an orientation in which it may be intended to be used (e.g., an orientation depicted in FIG. 1). A side of the multifunction device 10, in which an opening 13 may be defined, may be defined as the front of the multifunction device 10. A front-rear direction 8 may be defined with reference to the front of the multifunction device 10. A right-left direction 9 may be defined with respect to the multifunction device 10 as viewed from the front of the multifunction device 10.

As depicted in FIG. 1, the multifunction device 10 may comprise a printer unit 11 at its lower portion. The multifunction device 10 may have various functions, for example, a facsimile function and a printing function. The multifunction device 10 may have a double-sided image recording function of recording images on both sides of a recording sheet 12 (see FIG. 2), as the printing function. The printer unit 11 may have the opening 13 defined in its front. A feed tray 20, on which one or more recording sheets 12 may be placed, and discharge tray 21 may be configured to be inserted into and removed from the printer unit 11 via the opening 13 in the front-rear direction 8.

Figure 2:
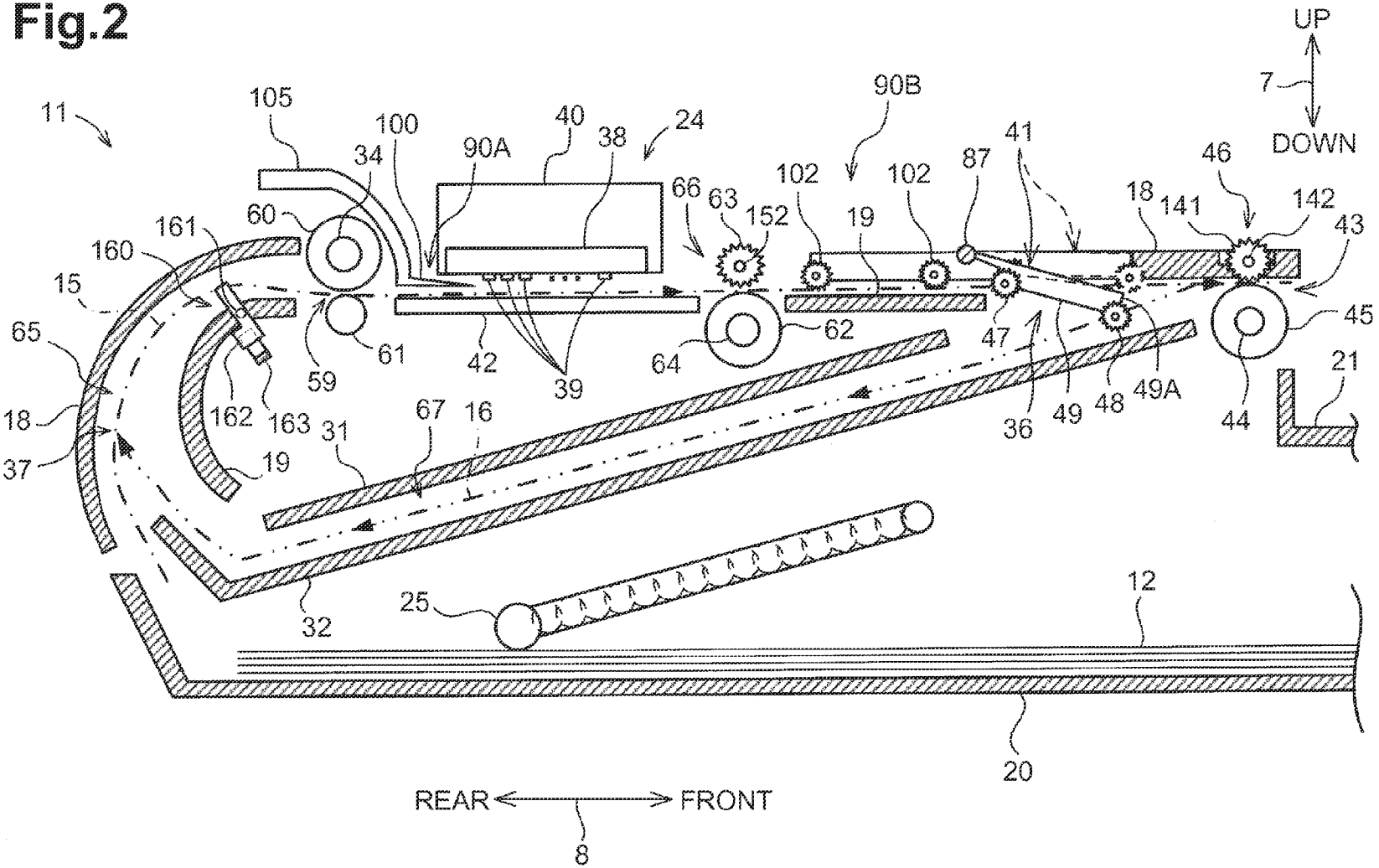
FIG. 2 is a schematic vertical sectional view depicting an internal configuration of a printer unit according to an embodiment of the invention.

As depicted in FIG. 2, a feed roller 25 may be disposed above the feed tray 20. When the feed tray 20 on which one or more recording sheets 12 are placed is attached in the multifunction device 10, the feed roller 25 may contact an uppermost recording sheet 12 of the one or more recording sheets 12. The feed roller 25 may be rotated by application of a drive force from a conveyor motor 71 (see FIGS. 3, 5A, and 6). Thus, the one or more recording sheets 12 placed on the feed tray 20 may be fed one by one toward a conveyor roller 60 through a first conveyance path 65. The power transmission from the conveyor motor 71 to the feed roller 25 is described below. In other embodiments, for example, the feed roller 25 may be applied with a drive force from a dedicated motor, instead of the conveyor motor 71.

The first conveyance path 65 may extend from a rear end of the feed tray 20. The first conveyance path 65 may comprise a curved section and a straight section. The first conveyance path 65 may be defined between an outside guide member 18 and an inside guide member 19 that may face each other and be spaced apart from each other at a predetermined interval. The one or more recording sheets 12 placed on the feed tray 20 may be conveyed upward one by one from below so as to be U-turned in the curved section, and then, may be further conveyed in the straight section to a recording unit 24 along the front-rear direction 8. The recording sheet 12 on which an image has been recorded by the recording unit 24 may be further conveyed in the straight section and then discharged onto the discharge tray 21. That is, the recording sheet 12 may be conveyed along a conveyance direction 15 indicated by a dotted-and-dashed line with an arrow in FIG. 2. The recording unit 24 is described in detail below.

As depicted in FIG. 2, a conveyor roller pair 59 comprising a conveyor roller 60 and a plurality of pinch rollers 61 may be disposed upstream of the recording unit 24 in the conveyance direction 15. The pinch rollers 61 may be in pressure contact with the conveyor roller 60 by, for example, a spring. With this configuration, the pinch rollers 61 may rotate following rotation of the conveyor roller 60.

Figure 3:
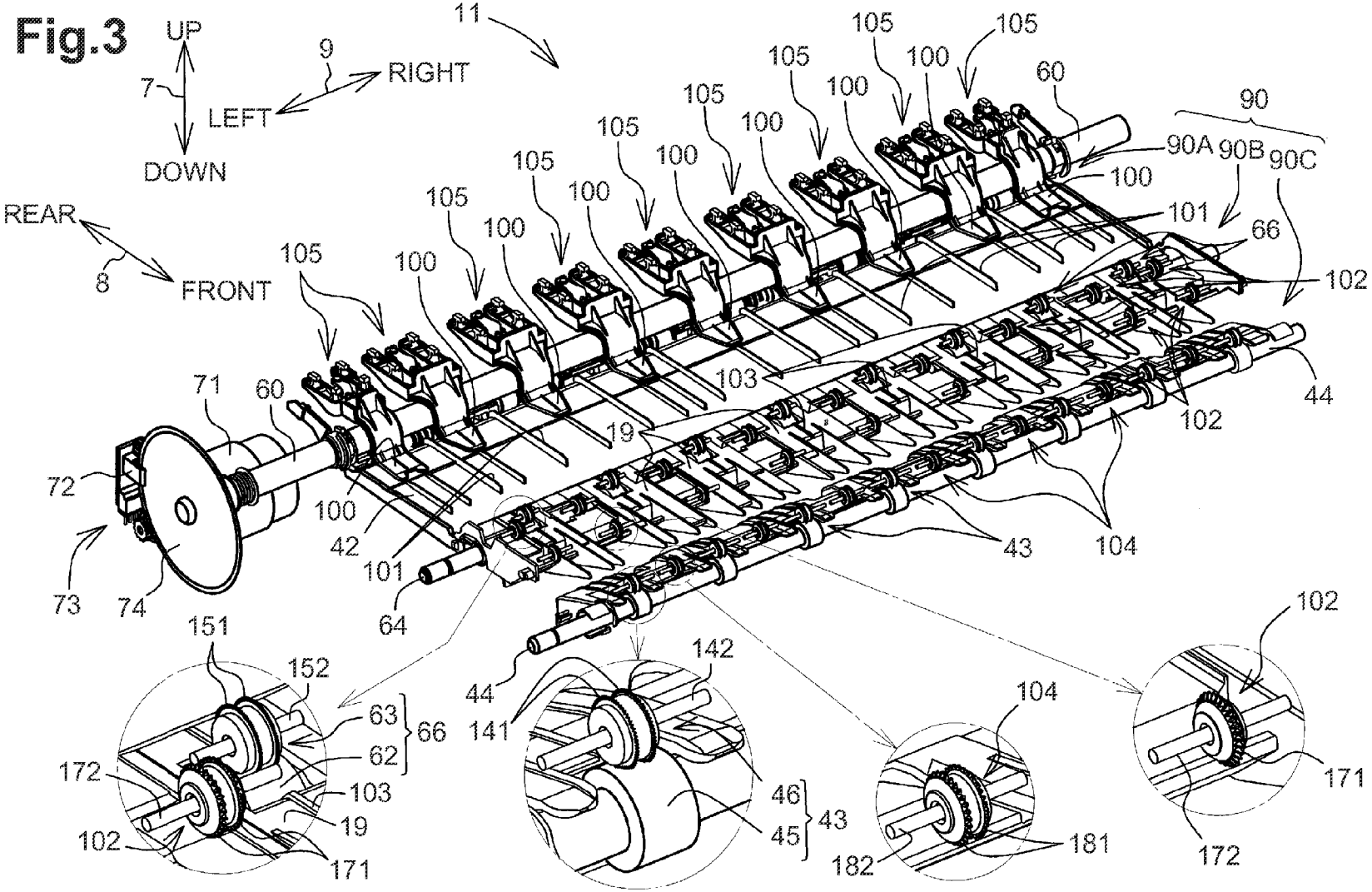
FIG. 3 is a perspective view depicting pressing portions, a platen, pressing spurs, and roller pairs according to an embodiment of the invention.

A plurality of discharge roller pairs 66, each of which may comprise a discharge roller 62 and a spur 63, may be disposed downstream of the recording unit 24 in the conveyance direction 15. As depicted in FIGS. 3 and 4B, the discharge roller pairs 66 may be spaced apart from each other in the right-left direction 9. Each of the discharge rollers 62 may comprise a shaft 64 passing therethrough. The spurs 63 may be spaced apart from each other in right-left direction 9 and disposed facing the discharge rollers 62, respectively. Each of the spurs 63 may comprise a roller portion 151, a rotation support portion 153, and an urging member 154. The roller portion 151 may be in contact with the corresponding discharge roller 62. The rotation support portion 153 may support the roller portion 151 such that the roller portion 151 may be rotatable about a shaft 152 extending along the right-left direction 9. The urging member 154 may comprise, for example, a spring, and urge the rotation support portion 153 and the roller portion 151 toward the corresponding discharge roller 62. One end of the urging member 154 may be connected to the rotation support portion 153 and the other end of the urging member 154 may be connected to a frame (not depicted) of the printer unit 11. With this configuration, the spurs 63 may be in pressure contact with the discharge rollers 62, respectively, and rotate following rotation of the discharge rollers 62, respectively.

As depicted in FIG. 2, a plurality of reversible roller pairs 43, each of which may comprise a reversible roller 45 and a spur 46, may be disposed downstream of the plurality of discharge roller pairs 66 in the conveyance direction 15. As depicted in FIG. 3, the reversible roller pairs 43 may be spaced apart from each other in the right-left direction 9. Each of the reversible rollers 45 may comprise a shaft 44 passing therethrough. The spurs 46 may be spaced apart from each other in the right-left direction 9 and disposed facing the reversible rollers 45, respectively. Each of the spurs 46 may comprise a roller portion 141, a rotation support portion (not depicted), and an urging member (not depicted). The roller portion 141 may be in contact with the corresponding reversible roller 45. The rotation support portion may support the roller portion 141 such that the roller portion 141 may be rotatable about a shaft 142 extending along the right-left direction 9. The urging member may comprise, for example, a spring, and urge the rotation support portion and the roller portion 141 toward the corresponding reversible roller 45. One end of the urging member may be connected to the rotation support portion and the other end of the urging member may be connected to the frame (not depicted) of the printer unit 11. With this configuration, the spurs 46 may be in pressure contact with the reversible rollers 45, respectively, and rotate following rotation of the reversible rollers 45, respectively.

When each of the roller pairs 59, 66, and 43 rotates while nipping therebetween a recording sheet 12 that is guided in the first conveyance path 65, each of the roller pairs 59, 66, and 43 may convey the recording sheet 12 in one of the conveyance direction 15 and a direction reverse to the conveyance direction 15. The conveyor roller 60, the discharge rollers 62, and the reversible rollers 45 may rotate by the application of a drive force from the conveyor motor 71 (see FIGS. 3, 5A, and 6) via a power transmission mechanism 50 (see FIGS. 5A-5D). The conveyor motor 71 may be configured to rotate in either one of a normal direction and a reverse direction. When a drive force is applied to the conveyor roller 60 from the conveyor motor 71 that rotates in the normal direction, the conveyor roller 60 may rotate in a second rotational direction. The second rotational direction may be a rotational direction that may convey a recording sheet 12 in the conveyance direction 15. When a drive force is applied to the conveyor roller 60 from the conveyor motor 71 that rotates in the reverse direction, the conveyor roller 60 may rotate in a first rotational direction reverse to the second rotational direction. The first rotational direction may be a rotational direction that may convey a recording sheet 12 in a direction reverse to the conveyance direction 15.

During double-sided image recording, an image may be recorded on a first surface of a recording sheet 12 and the recording sheet 12 may be conveyed in the first conveyance path 65 along the conveyance direction 15. Then, after a trailing edge of the recording sheet 12 reaches a position between the discharge roller pairs 66 and the reversible roller pairs 43, the recording sheet 12 may be turned back and further conveyed toward the second conveyance path 67.

A combined conveyance force of the conveyor roller pair 59 and the discharge roller pairs 66 may be greater than a conveyance force of the reversible roller pairs 43. The conveyance force may refer to the force that each of the roller pairs 59, 66, and 43 may convey a recording sheet 12 while nipping the recording sheet 12 therebetween. The conveyance force of the each of the roller pairs 59, 66, and 43 may be determined based on, for example, a rotating speed or material of a roller constituting each of the roller pairs 59, 66, and 43 or a nipping force of each of the roller pairs 59, 66, and 43.

As depicted in FIG. 2, the recording unit 24 may be disposed downstream of the conveyor roller pair 59 in the conveyance direction 15 and upstream of the discharge roller pairs 66 in the conveyance direction 15. A platen 42 may be disposed below the recording unit 24 and face the recording unit 24. The platen 42 may support a recording sheet 12 being conveyed in the first conveyance path 65. The recording unit 24 may record an image onto the recording sheet 12 held by the platen 42 using an inkjet method. The recording unit 24 may comprise a recording head 38 in which a plurality of nozzles 39 may be defined to eject ink droplets toward a recording sheet 12 and a carriage 40 equipped with the recording head 38.

The carriage 40 may be supported by the frame of the printer unit 11 such that the carriage 40 may be configured to reciprocate in the right-left direction 9 (e.g., a direction perpendicular to a surface of the drawing sheet of FIG. 2). The carriage 40 may be connected to a carriage drive motor 53 (see FIG. 6) via a belt mechanism. The carriage 40 may reciprocate in the right-left direction 9 by the transmission of a drive force from the carriage drive motor 53. The carriage 40 may reciprocate while a recording sheet 12 may be supported by the platen 42. Ink droplets may be ejected from the recording head 38 while the carriage 40 may reciprocate. Thus, an image may be recorded on the recording sheet 12 supported by the platen 42.

As depicted in FIGS. 2 and 3, a corrugate mechanism 90 may be disposed upstream of the reversible roller pairs 43 in the conveyance direction 15. The corrugate mechanism 90 may comprise a first corrugate mechanism 90A, a second corrugate mechanism 90B and a third corrugate mechanism 90C. The first corrugate mechanism 90A may comprise a plurality of pressing portions 100 and the platen 42. The second corrugate mechanism 90B may comprise the plurality of discharge roller pairs 66 and a plurality of pressing spurs 102. The third corrugate mechanism 90C may comprise the plurality of reversible roller pairs 43 and a plurality of pressing spurs 104. The pressing portions 100, the pressing spurs 102, and the pressing spurs 104 may be examples of a contact portion. The platen 42 may comprise a plurality of first support ribs 101. The first support ribs 101 may be an example of a protrusion.

As depicted in FIG. 2, the pressing portions 100 may be disposed downstream of the conveyor roller pair 59 in the conveyance direction 15 and upstream of the nozzles 39, which may be defined in the recording unit 24, in the conveyance direction 15. As depicted in FIG. 3, the pressing portions 100 may be spaced apart from each other in the right-left direction 9. The pressing portions 100 may be distal end portions of pressing members 105 that may be spaced apart from each other in the right-left direction 9. In each of the pressing members 105, a proximal end portion of the pressing member 105 may be fixed to the frame (not depicted) of the printer unit 11 above the conveyor roller pair 59. Each of the pressing members 105 may curvedly extend forward and downward from the proximal end portion to the distal end portion. Lower surfaces of the pressing portions 100 may come into contact with an upper surface of the recording sheet 12 being conveyed in the first conveyance path 65. For example, the lower surface of the pressing portions 100 may contact the recording sheet 12 from above the recording sheet 12.

As depicted in FIG. 3, the first support ribs 101 may be disposed on an upper surface of the platen 42. The first support ribs 101 may be disposed downstream of the conveyor roller pair 59 in the conveyance direction 15 and upstream of the discharge roller pairs 66 in the conveyance direction 15, and may extend in the front-rear direction 8. Each of the first support ribs 101 may be disposed between respective pairs of the pressing portions 100 in the right-left direction 9. The first support ribs 101 may protrude such that their upper ends may be located higher than lower ends of the pressing portions 100 in the up-down direction 7. The upper ends of the first support ribs 101 may support a bottom surface of the recording sheet 12 being conveyed in the first conveyance path 65. For example, the upper ends of the first support ribs 101 may contact the recording sheet 12 from below the recording sheet 12.

Figure 4A:
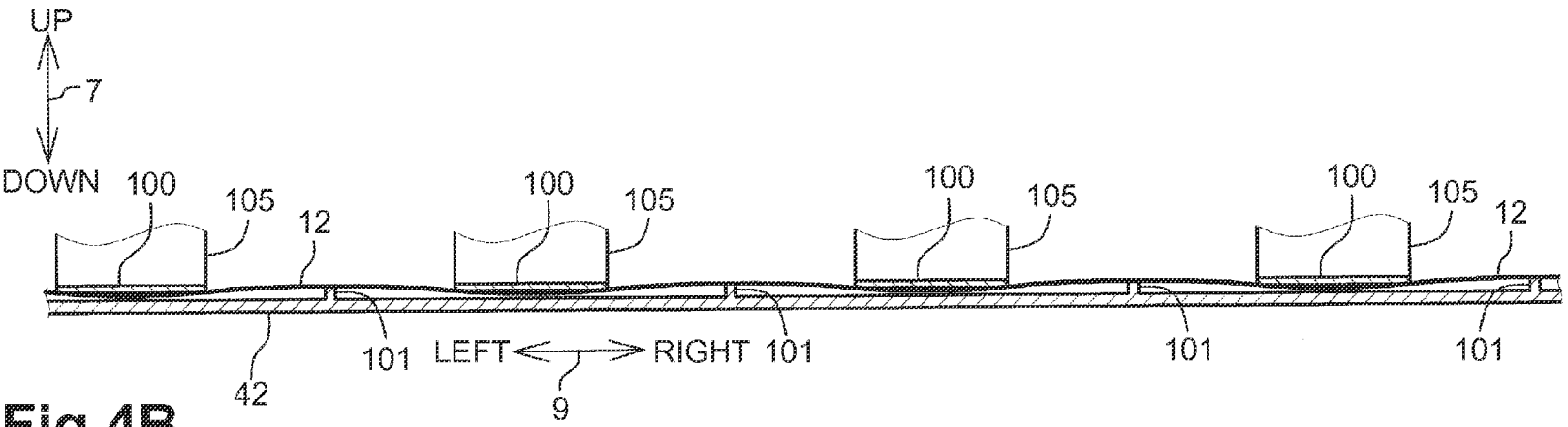
FIG. 4A is a front view depicting the platen, the pressing portions, and a recording sheet according to an embodiment of the invention.
Figure 4B:
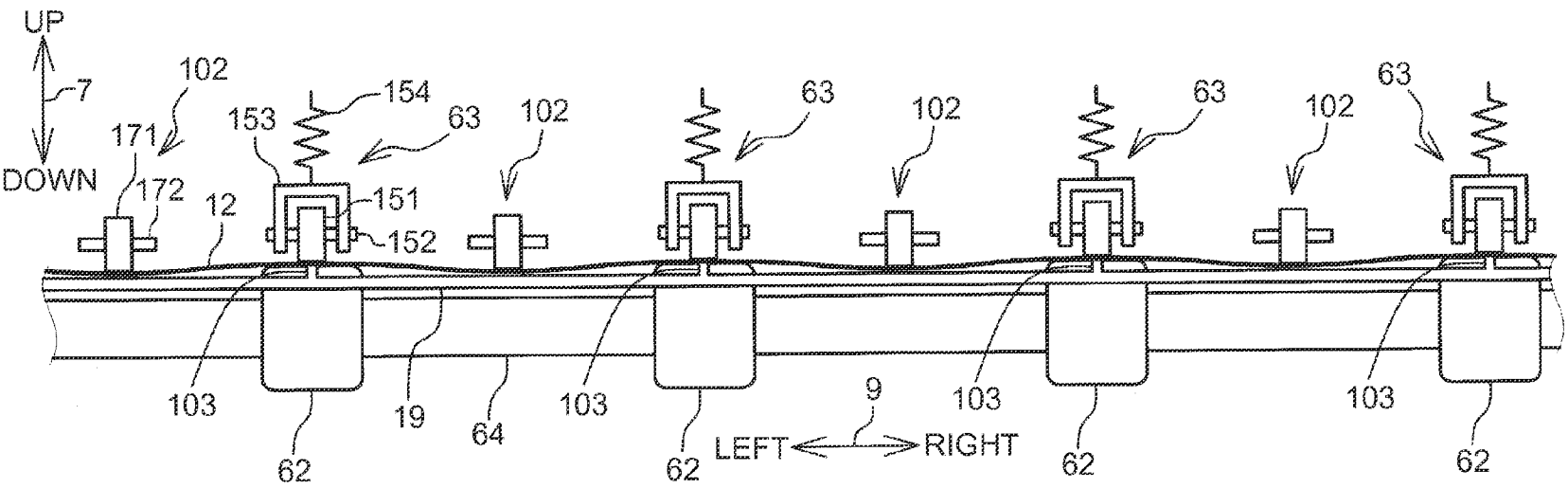
FIG. 4B is a front view depicting an inside guide member, the pressing spurs, and the discharge roller pair according to an embodiment of the invention.

With this configuration, as depicted in FIG. 4A, a recording sheet 12 being conveyed by the conveyor roller pair 59 may be formed into a continuous corrugated shape in the right-left direction 9 at a position downstream of the conveyor roller pair 59 in the conveyance direction 15 and upstream of the nozzles 39, which may be defined in the recording unit 24, in the conveyance direction 15, by the pressing portions 100 and the first support ribs 101.

As depicted in FIG. 2, the pressing spurs 102 may be disposed downstream of the nozzles 39 in the conveyance direction 15 and upstream of the reversible roller pairs 43 in the conveyance direction 15. The pressing spurs 102 may be disposed at two locations in the front-rear direction 8. Nevertheless, in other embodiments, for example, the pressing spurs 102 may be disposed at one location or three or more locations, instead of two locations. As depicted in FIG. 3, the plurality of pressing spurs 102 may be spaced apart from each other in the right-left direction 9 at the respective two locations. Each of the pressing spurs 102 may comprise a shaft 172 extending in the right-left direction 9 and a roller portion 171 disposed on the shaft 172. A peripheral surface of the roller portion 171 may have a spur shape. The shaft 172 may be rotatably supported by the frame (not depicted) of the printer unit 11. The roller portions 171 may be disposed at the same positions, in the right-left direction 9, as the pressing portions 100. That is, the pressing spurs 102 may be spaced apart from each other in the right-left direction 9 at the respective positions corresponding to the pressing portions 100 in the conveyance direction 15. The peripheral surfaces of the roller portions 171 of the pressing spurs 102 may come into contact with the top surface of the recording sheet 12 being conveyed in the first conveyance path 65. For example, the peripheral surfaces of the roller portions 171 may contact the recording sheet 12 from above the recording sheet 12.

As depicted in FIG. 3, second support ribs 103 may be disposed on the inside guide member 19 that may be disposed downstream of the platen 42 in the conveyance direction 15 and upstream of the reversible roller pairs 43 in the conveyance direction 15. The second support ribs 103 may be another example of the protrusion. The second support ribs 103 may protrude upward from the inside guide member 19 and extend in the front-rear direction 8. The second support ribs 103 may be disposed at the same positions, in the right-left direction 9, as the first support ribs 101. That is, the second support ribs 103 may be disposed at the respective positions corresponding to the first support ribs 101 in the conveyance direction 15. Each of the second support ribs 103 may be disposed between the respective pairs of the pressing spurs 102 in the right-left direction 9. The second support ribs 103 may protrude such that their upper ends may be located higher than lower ends of the pressing spurs 102. The upper ends of the second support ribs 103 may support the bottom surface of the recording sheet 12 being conveyed in the first conveyance path 54. For example, the upper ends of the second support ribs 103 may contact the recording sheet 12 from below the recording sheet 12.

With this configuration, as depicted in FIG. 413, a recording sheet 12 being conveyed by the conveyor roller pair 59 may be formed into a continuous corrugated shape in the right-left direction 9 at a position downstream of the nozzles 39 in the conveyance direction 15 and upstream of the reversible roller pairs 43 in the conveyance direction 15 by the pressing spurs 102 and the second support ribs 103.

The spurs 63 of the discharge roller pairs 66 may be disposed at the same positions, in the right-left direction 9, as the second support ribs 103. That is, each of the spurs 63 of the discharge roller pairs 66 may be disposed between the respective pairs of the pressing spurs 102 in the right-left direction 9. Nip points at which the discharge roller pairs 66 may nip a recording sheet 12 may be located higher than the lower ends of the pressing spurs 102.

With this configuration, a recording sheet 12 being conveyed by the conveyor roller pair 59 may be formed into a continuous corrugated shape in the right-left direction 9 (see FIG. 4B) by the pressing spurs 102 and the discharge roller pairs 66.

As depicted in FIG. 3, the pressing spurs 104 may be disposed at the same positions, in the front-rear direction 8, as the spurs 46 of the reversible roller pairs 43. The pressing spurs 104 may be spaced apart from each other in the right-left direction 9. Each of the pressing spurs 104 may comprise a shaft 182 extending in the right-left direction 9 and a roller portion 181 disposed on the shaft 182. A peripheral surface of the roller portion 181 may have a spur shape. The shaft 182 may be rotatably supported by the frame (not depicted) of the printer unit 11. The roller portions 181 may be disposed at the same positions, in the right-left direction 9, as the pressing portions 100 and the roller portions 171 of the pressing spurs 102. Thai is, the pressing spurs 104 may be spaced apart from each other in the right-left direction 9 at the respective positions corresponding to the pressing portions 100 and the pressing spurs 102 in the conveyance direction 15. The peripheral surfaces of the roller portions 181 of the pressing spurs 104 may come into contact with the top surface of the recording sheet 12 being conveyed in the first conveyance path 65. For example, the peripheral surfaces of the roller portion 181 may contact the recording sheet 12 from above the recording sheet 12.

The spurs 46 of the reversible roller pairs 43 may be disposed at the same positions, in the right-left direction 9, as the second support ribs 103. That is, each of the spurs 46 of the reversible roller pairs 43 may be disposed between the respective pairs of the adjacent pressing spurs 104 in the right-left direction 9. Nip points at which the reversible roller pairs 43 may nip a recording sheet 12 may be located higher than the lower ends of the pressing spurs 104.

With this configuration, a recording sheet 12 being conveyed by the conveyor roller pair 59 may be formed into a continuous corrugated shape in the right-left direction 9 at the same positions, in the front-rear direction 8, as the reversible roller pairs 43, by the pressing spurs 104 and the reversible roller pairs 43.

As described above, the corrugate mechanism 90 may form a continuous corrugated shape in a recording sheet 12 in the right-left direction 9 while the recording sheet is conveyed in the conveyor roller pair 59.

As depicted in FIG. 2, a path switching member 141 may be disposed between the discharge roller pairs 66 and the reversible roller pairs 43. The path switching member 141 may comprise auxiliary rollers 47 and 48, a flap 49, and a shaft 87. The flap 49 may extend from the shaft 87 in substantially the conveyance direction 15 and may be rotatably supported by the shaft 87. The spur-like auxiliary rollers 47 and 48 may be rotatably supported by the flap 49.

The flap 49 may be configured to be pivotable between a sheet-discharge position (e.g., indicated by a dashed line in FIG. 2) and a sheet-reverse position (e.g., indicated by a solid line in FIG. 2). When the flap 49 is located in the sheet-discharge position, the flap 49 may allow the recording sheet 19 to be discharged onto the discharge tray 21. When the flap 49 is located in the sheet-reverse position, an extended end portion 49A of the flap 49 may be located lower than the extended end portion 49A of the flap 49 located in the sheet-discharge position.

The flap 49 may be configured to stay in the sheet-reverse position under its own weight when the flap 49 is in a standby state. When the flap 49 is made to contact with and be raised by a leading edge of a recording sheet 12 being conveyed in the first conveyance path 65, the flap 49 may pivotally move to the sheet-discharge position. When a trailing edge (e.g., an upstream edge in the conveyance direction 15) of the recording sheet 12 being conveyed passes the auxiliary roller 47, the flap 49 may move or return pivotally to the sheet-reverse position from the sheet discharge position under its own weight. Thus, the direction in which the trailing edge of the recording sheet 12 being conveyed points may be changed to a downward direction. As a result, the trailing edge of the recording sheet 12 being conveyed may point toward the second conveyance path 67. When the rotation of the reversible rollers 45 in the second rotational direction continues under this condition, the recording sheet 12 may be conveyed along the conveyance direction 15 and thus may be discharged onto the discharge tray 21. When the rotational direction of the reversible rollers 45 is switched to the first rotational direction while the trailing edge of the recording sheet 12 points toward the second conveying path 67, the recording sheet 12 may be conveyed along a direction reverse to the conveyance direction 15 and thus may be guided into the second conveying path 67. As described above, the reversible roller pairs 43 may convey the recording sheet 12 along the conveyance direction 15 by rotating in the second rotational direction, and may convey the recording sheet 12 along the direction reverse to the conveyance direction 15, that is, toward the second conveyance path 67, by rotating in the first rotational direction.

Figure 8A:
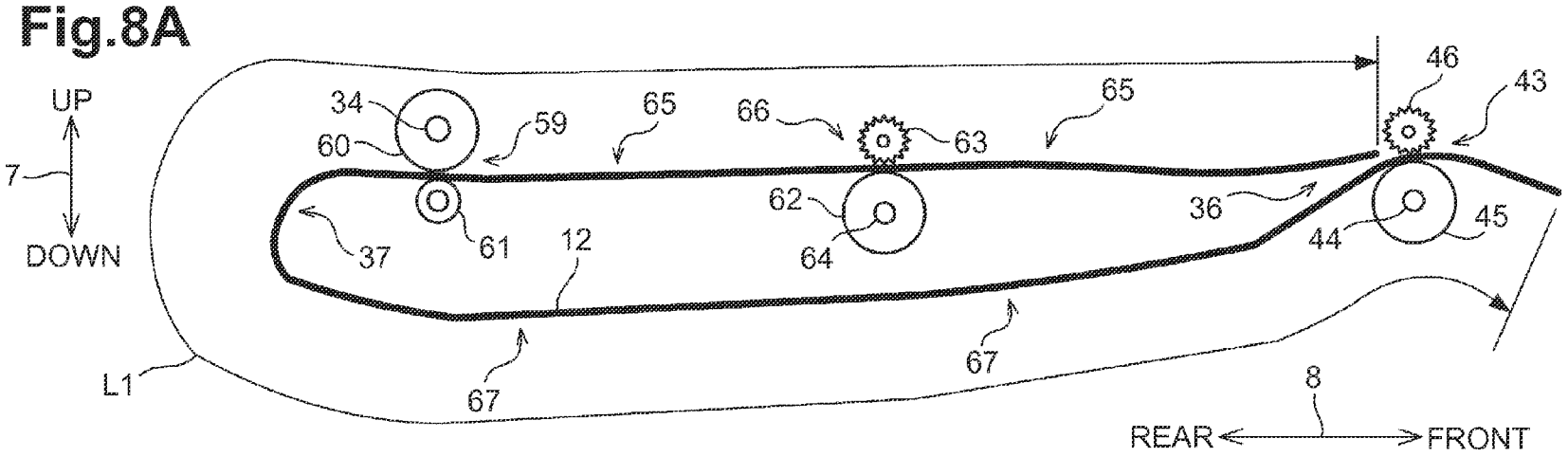
FIG. 8A is a diagram depicting the roller pairs depicted in FIG. 2, wherein a recording sheet is depicted for explaining a length of the recording sheet according to an embodiment of the invention.
Figure 8B:
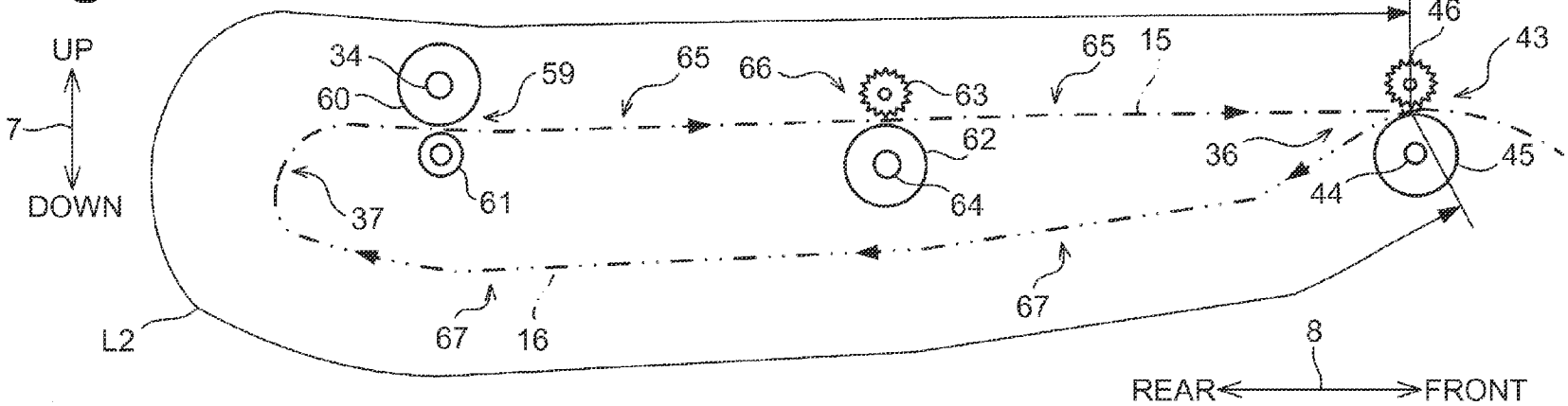
FIG. 8B is a diagram depicting the roller pairs depicted in FIG. 2, wherein conveyance directions are depicted for explaining a length of a conveyance path according to an embodiment of the invention.

The second conveyance path 67 may branch off from the first conveyance path 65 at a first junction 36 and join the first conveyance path 65 again at a second junction 37. The first junction 36 may be located downstream of the discharge roller pairs 66 in the conveyance direction 15 and upstream of the reversible roller pairs 43 in the conveyance direction 15. The second junction 37 may be located upstream of the conveyor roller pair 59 in the conveyance direction 15. That is, the second conveyance path 67 may be connected to the first conveyance path 65 at the first junction 36 and at the second junction 37. In other words, when the reversible roller pairs 43 rotate in the first rotational direction, the reversible roller pairs 43 may convey the recording sheet 12 in the second conveyance path 67 along a conveyance direction 16 (e.g., a direction indicated by a double-dotted and dashed line in FIGS. 2 and 8B) that may extend toward the second junction 37 from the first junction 36. The second conveyance path 67 may be between a guide member 31 and a guide member 32.

As depicted in FIG. 2, a detector 160 may be disposed upstream of the conveyor roller 60 in the conveyance direction 15 and downstream of the second junction 37 in the conveyance direction 15. The installation location of the detector 160 might not be limited to the above-described location. In other embodiments, for example, the detector 160 may be disposed at another position in the first conveyance path 65 or at a position in the second conveyance path 67. A plurality of detectors 160 may be provided in the printer unit 11 instead of a single detector 160. For example, one detector 160 may be disposed in the first conveyance path 65 and another detector 160 may be disposed in the second conveyance path 67.

The detector 160 may comprise a shaft 161, a detector element 162, and an optical sensor 163. The detector element 162 may be configured to be pivotable on the shaft 161. The optical sensor 163 may comprise a light-emitting device and a light-receiving device that may be configured to receive light emitted from the light-emitting device. One end of the detector element 162 may protrude into the first conveyance path 65. When an external force is not applied to the one end of the detector element 162, the other end of the detector element 162 may be present in an optical path of light emitted from the light-emitting device to the light-receiving device in the optical sensor 163 to interrupt travel of light traveling the optical path. In this situation, the optical sensor 163 may output a low-level signal to a microcomputer 130 (see FIG. 6). When the one end of the detector element 112 is pivoted by a leading edge of the recording sheet 12 being conveyed, the other end of the detector element 162 may be moved to out of the optical path. Thus, light may travel along the optical path. In this situation, the optical sensor 113 may output a high-level signal to the microcomputer 130. With this configuration, the detector 160 may detect a trailing edge (e.g., an upstream edge in the conveyance direction 15) and a leading edge (e.g., a downstream edge in the conveyance direction 15) of a recording sheet 12 in the conveyance direction 15.

As depicted in FIG. 3, a rotary encoder 73 may be disposed on the conveyor roller 60. The rotary encoder 73 may be configured to generate a pulse signal by the rotation of the conveyor roller 60. In other embodiments, for example, the rotary encoder 73 may be disposed on, for example, one of the discharge rollers 62 and the reversible rollers 45, other than the conveyor roller 60.

The rotary encoder 73 may be disposed on a shaft 34 of the conveyor roller 60 and may comprise an encoder disk 74 and an optical sensor 72. The encoder disk 74 may be configured to rotate integrally with the conveyor roller 60. The encoder disk 74 may have a pattern in which a transmitting portion and a non-transmitting portion may be alternately arranged in a circumference direction at regular intervals. The transmitting portion may allow light to pass therethrough and the non-transmitting portion might not allow light to pass therethrough. As the encoder disk 74 rotates, a pulse signal may be generated every time the optical sensor 72 detects the transmitting portion and the non-transmitting portion alternately. The generated pulse signal may be outputted to the microcomputer 130. With this configuration, the rotary encoder 73 may detect an amount of rotation of the conveyor roller 60.

Figure 5A:
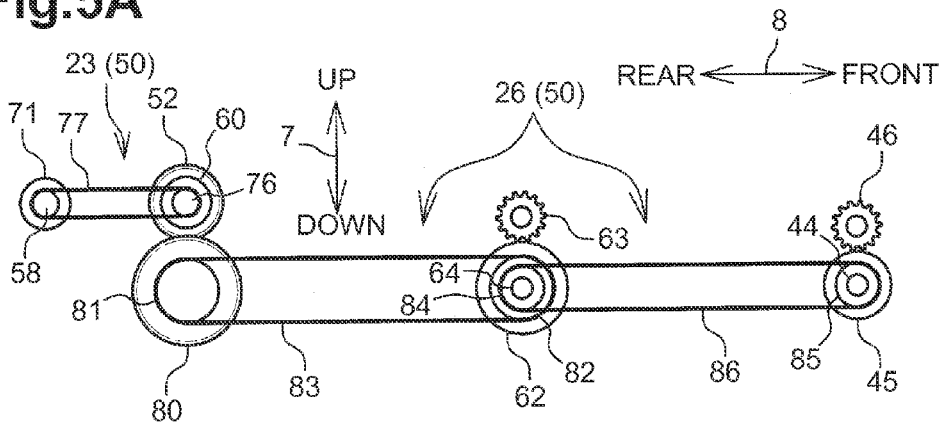
FIG. 5A is a schematic left side view depicting a first power transmission mechanism, a second power transmission mechanism, and their surrounding portions according to an embodiment of the invention.
Figure 5B:
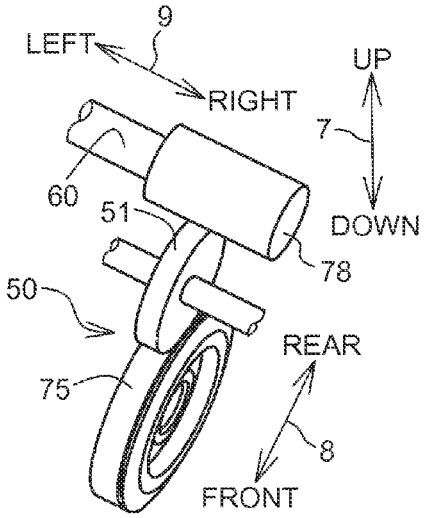
FIG. 5B is a schematic perspective view depicting a switch gear located in an engaged position and its surrounding portion according to an embodiment of the invention.
Figure 5C:
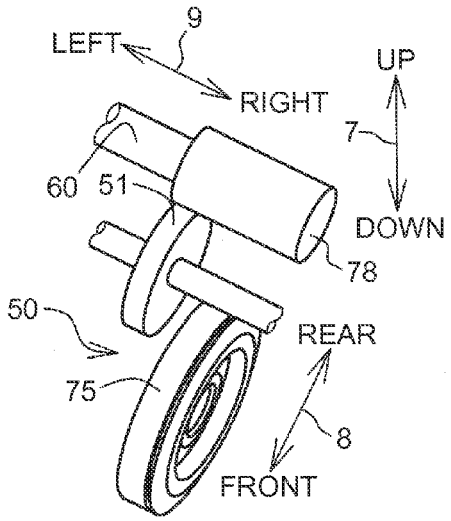
FIG. 5C is a schematic perspective view depicting the switch gear located in a neutral position and its surrounding portion according to an embodiment of the invention.

The printer unit 11 may comprise the power transmission mechanism 50 as depicted in FIGS. 5A and 5B. The power transmission mechanism 50 may comprise a first power transmission mechanism 23, a second power transmission mechanism 26, and a third power transmission mechanism 27, a switch gear 51, a first gear 78, and a second gear 75. Nevertheless, the power transmission mechanism 50 might not be limited to a configuration described below as long as the power transmission mechanism 50 may have a function of transmitting a rotational drive three of the conveyor motor 71 to each of the rollers 25, 60, 62, and 45.

As depicted in FIG. 5A, the first power transmission mechanism 23 may comprise a motor pulley 58, a roller pulley 76, and a first belt 77 that may be an endless annular belt. The motor pulley 58 may be disposed on a shaft of the conveyor motor 71. The roller pulley 76 may be disposed on the shaft 34 of the conveyor roller 60. The first belt 77 may be hung between the motor pulley 58 and the roller pulley 76. With this configuration, the first power transmission mechanism 23 may transmit a rotational drive force of the conveyor motor 71 to the conveyor roller 60.

As depicted in FIG. 5A, the second power transmission mechanism 26 may comprise an upper gear 52, a lower gear 80, a first pulley 81, a second pulley 82, a third pulley 84, a fourth pulley 85, a second belt 83, and a third belt 86. The upper gear 52 may be disposed on the shaft 34 of the conveyor roller 60 and at a further left position than the first conveyance path 65. The lower gear 80 may be disposed below the upper gear 52 and may be in engagement with the upper gear 52. The first pulley 81 may be disposed at the left of the lower gear 80. The first pulley 81 may rotate coaxially and integrally with the lower gear 80. Thus, the first pulley 81 may rotate following the rotation of the conveyor roller 60. The second pulley 82 may be disposed on the shaft 64 of the discharge roller 62. The second belt 83 that may be an endless annular belt may be hung between the first pulley 81 and the second pulley 82. With this configuration, as the conveyor roller 60 rotates, the second belt 83 may rotate in a circumferential direction. Thus, a rotational drive force of the conveyor roller 60 may be transmitted to the discharge rollers 62.

The third pulley 84 may be disposed on the shaft 64 at the left of the second pulley 82. The third pulley 84 may rotate coaxially and integrally with the second pulley 82. The fourth pulley 85 may be disposed on the shaft 44 of the reversible rollers 45. The third belt 86 that may be an endless annular belt may be hung between the third pulley 84 and the fourth pulley 85. With this configuration, a rotational drive force of the discharge rollers 62 may be transmitted to the reversible rollers 45.

A rotational drive force may be transmitted from the conveyor motor 71 to the conveyor roller 60, the discharge rollers 62, and the reversible rollers 45 by the first power transmission mechanism 23 and the second power transmission mechanism 26 configured as described above. Therefore, when the conveyor roller 60 rotates to convey a recording sheet 12 in the conveyance direction 15, the discharge rollers 62 and the reversible rollers 45 may also rotate to convey the recording sheet 12 in the conveyance direction 15. When the conveyor roller 60 rotates to convey a recording sheet 12 in the direction reverse to the conveyance direction 15, the discharge rollers 62 and the reversible rollers 45 may also rotate to convey the recording sheet 12 in the direction reverse to the conveyance direction 15. In this case, the reversible rollers 45 may rotate to convey the recording sheet 12 toward the second conveyance path 67.

That is, when the conveyor roller 60 rotates in the second rotational direction, the discharge rollers 62 and the reversible rollers 45 may also rotate in the second rotational direction. When the conveyor roller 60 rotates in the first rotational direction, the discharge rollers 62 and the reversible rollers 45 may also rotate in the first rotational direction. With this configuration, the conveyor roller 60, the discharge rollers 62, and the reversible rollers 45 may be rotated in one of the normal direction and the reverse direction by the common conveyor motor 71 such that the conveyor roller 60, the discharge rollers 62, and the reversible rollers 45 may convey a recording sheet 12 in the same direction in synchronization with each other. That is, the discharge rollers 62 and the reversible rollers 45 may rotate in synchronization with the rotation of the conveyor roller 60.

As depicted in FIG. 5B, the first gear 78 may be disposed on the shaft 34 (see FIG. 2) of the conveyor roller 60 and at a further right position than the first conveyance path 65 (see FIG. 2). The switch gear 51 may be in configured to be engaged with the first gear 78. The second gear 75 may be configured to be engaged with the switch gear 51. The switch gear 51 may be configured to be movable in the right-left direction 9. The switch gear 51 may be movable between an engaged position (e.g., a position depicted in FIG. 5B) and a neutral position (e.g., a position depicted in FIG. 5C). When the switch gear 51 is located at the engaged position, the switch gear 51 may be in engagement with the second gear 75. When the switch gear 51 is located at the neutral position, the switch gear 51 might not be in engagement with the second gear 75. A mechanism may adopted to move the switch gear 51. For example, in one case, the switch gear 51 may be configured to move in the right-left direction 9 by the transmission of a drive force from an actuator. In another case, the switch gear 51 may be configured to move rightward by the pressing of the carriage 40 moving in the right-left direction 9 and to move leftward by an urging force of a spring (not depicted) disposed on the switch gear 51.

Figure 5D:
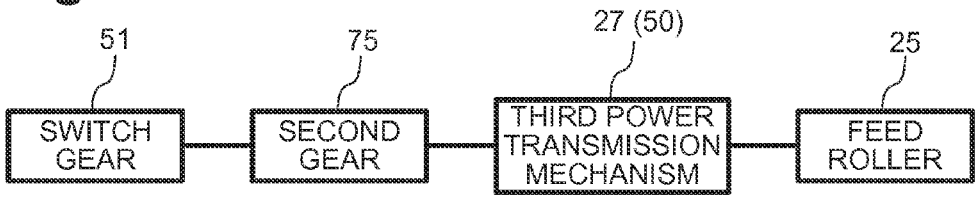
FIG. 5D is a block diagram depicting power transmission from a switch gear to a feed roller according to an embodiment of the invention.

When the switch gear 51 is located at the engaged position, a rotational drive force transmitted from the conveyor motor 71 to the switch gear 51 may be further transmitted to the feed roller 25 via the second gear 75 and the third power transmission mechanism 27, as depicted in FIG. 5D. The third power transmission mechanism 27 may comprise a gear and a belt. For example, the third power transmission mechanism 27 may comprise a planetary gear mechanism and may be configured to rotate the feed roller 25 in one direction, more specifically, in only a direction that feeds a recording sheet 12 from the feed tray 20 to the first conveyance path 65. When the switch gear 51 is located at the neutral position, a rotational drive force transmitted from the conveyor motor 71 to the switch gear 51 might not be transmitted to the feed roller 25.

That is, in accordance with the switching of the position of the switch gear 51, the feed roller 25 may be switched between a rotating state and a stationary state, in other words, between a state where the feed roller 25 may feed one or more recording sheets 12 placed on the feed tray 20 into the first conveyance path 65 and a state where the feed roller 25 might not feed the one or more recording sheets 12 into the first conveyance path 65.

Figure 6:
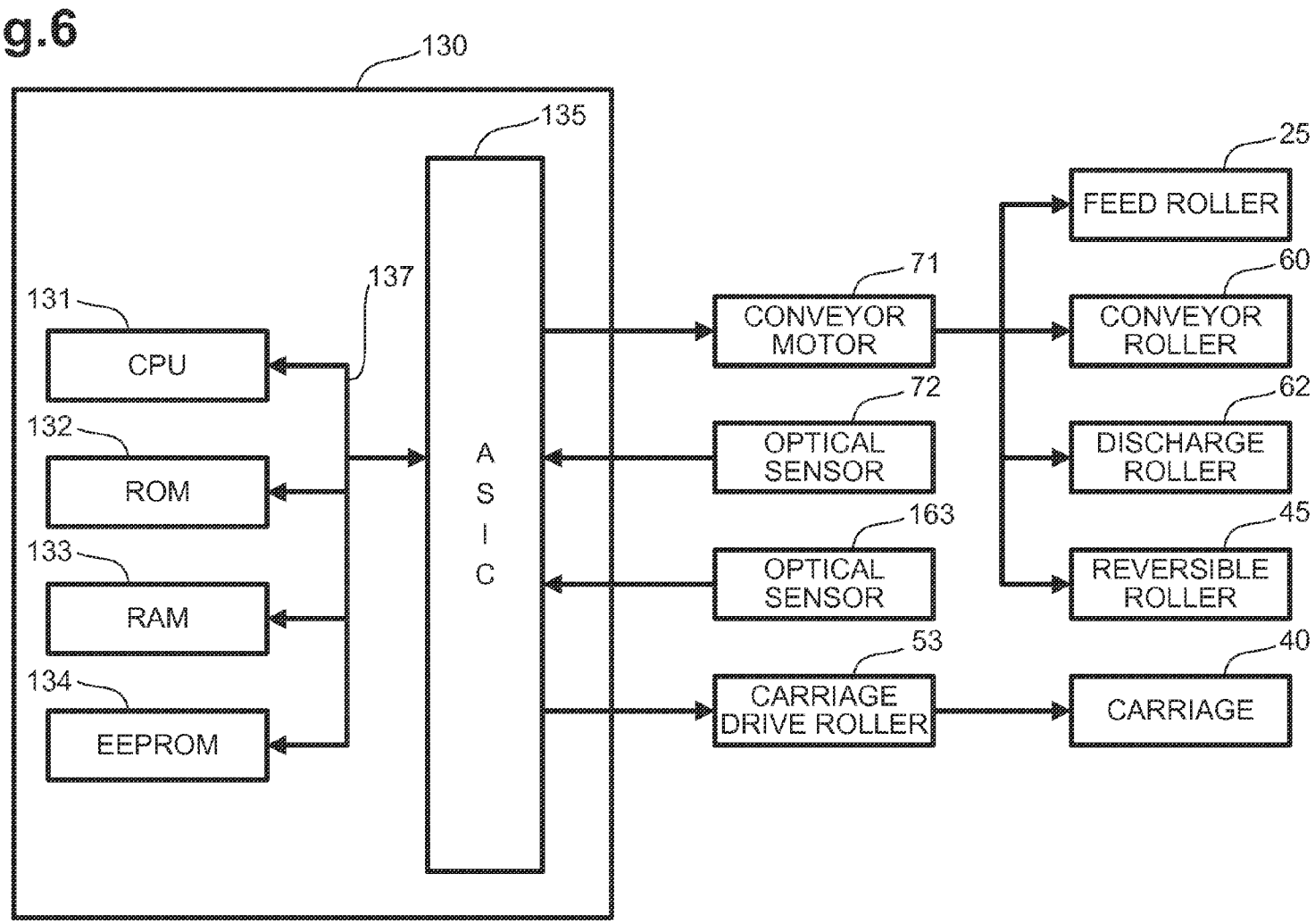
FIG. 6 is a block diagram depicting a configuration of a microcomputer according to an embodiment of the invention.

The microcomputer 130 depicted in FIG. 6 may be configured to control an overall operation of the multifunction device 10. For example, the microcomputer 130 may control the conveyor motor 71. In addition, for example, the microcomputer 130 may control the driving of the carriage drive motor 53 to move the carriage 40. The microcomputer 130 may comprise a central processing unit ("CPU") 131, a read-only memory ("ROM") 132, a random-access memory ("RAM") 133, an electrically erasable programmable read-only memory ("EEPROM") 134, an application-specific integrated circuit ("ASIC") 135, and an internal bus 137 that may connect these components to each other.

The ROM 132 may store programs for controlling various operations to be performed by the CPU 131. The RAM 133 may be used as a storage area for temporarily storing data and signals to be used when the CPU 131 carries out the program. The EEPROM 134 may store settings and flags that may need to be maintained after power of the multifunction device 10 is turned off.

The conveyor motor 71 and the carriage drive motor 53 may be connected to the ASIC 135. As a drive signal for rotating a predetermined motor is inputted from the CPU 131 to a drive circuit corresponding to the predetermined motor, a drive current corresponding to the drive signal may be outputted to the motor corresponding to the drive circuit. Thus, the corresponding motor may be rotated in one of the normal direction or the reverse direction at a predetermined rotating speed.

A pulse signal outputted from the optical sensor 72 (see FIG. 3) of the rotary encoder 73 may be inputted to the ASIC 135. The microcomputer 130 may calculate the amount of rotation of the conveyor roller 60 based on the pulse signal received from the optical sensor 72. The optical sensor 163 of the detector 160 may be connected with the ASIC 135. The microcomputer 130 may detect a trailing edge and a leading edge of a recording sheet 12 in the conveyance direction 15 at the disposed position of the detector 160, based on a signal from the optical sensor 163. Then, the microcomputer 130 may determine the positions of the trailing edge and the leading edge of the recording sheet 12 being conveyed in the conveyance direction 15, based on the amount of rotation of the conveyor roller 60 and the detected timing of the trailing edge and the leading edge of the recording sheet 12 in the conveyance direction 15 at the disposed position of the detector 160.

Figure 7:
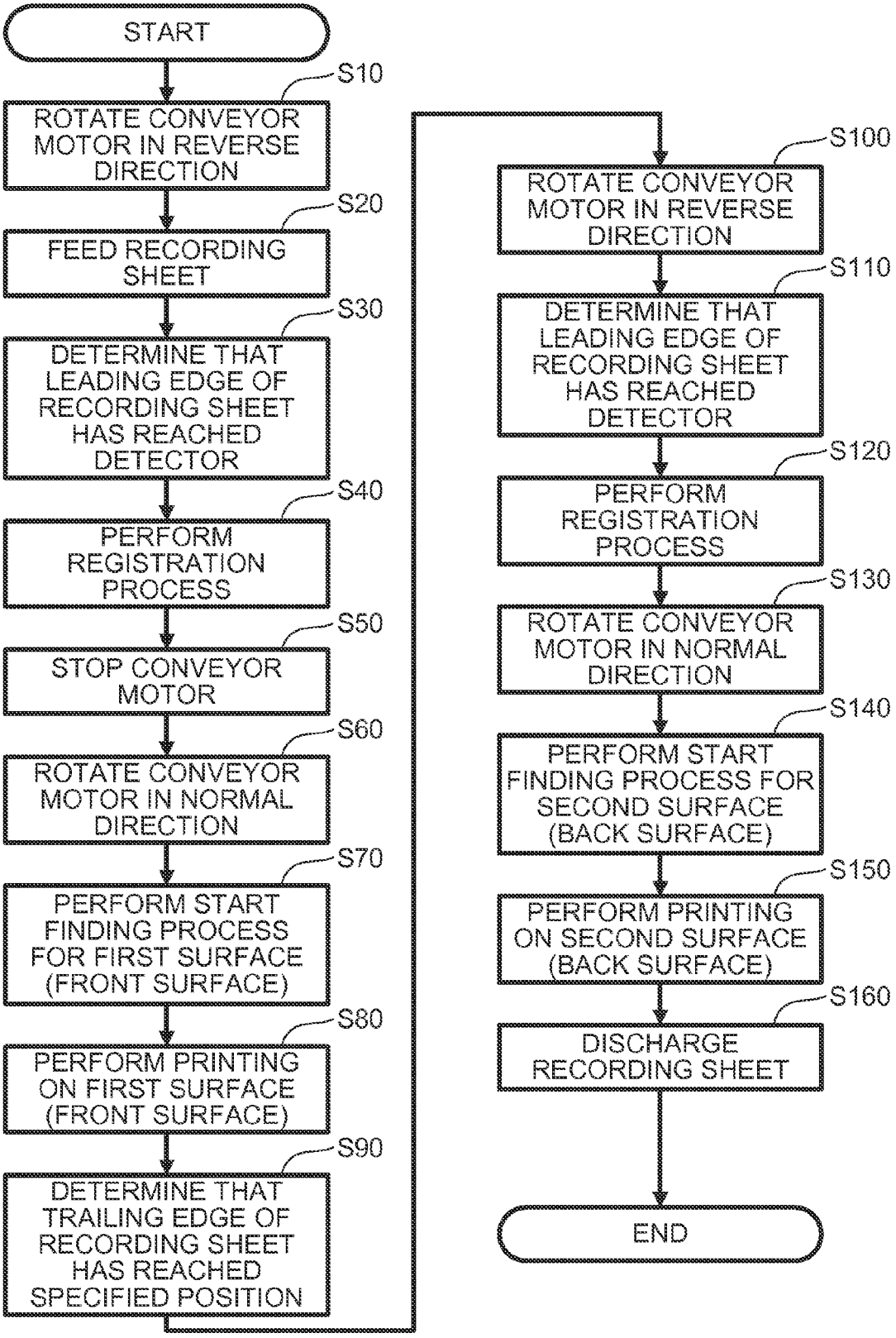
FIG. 7 is a flowchart depicting an example procedure of a process performed by the microcomputer to perform double-sided image recording on a recording sheet according to an embodiment of the invention.

A procedure of a double-sided image recording process to be performed on a recording sheet 12 by the microcomputer 130 is described with reference to a flowchart depicted in FIG. 7. Steps performed by a control device may be implemented by execution of the process by the microcomputer 130, as discussed below. That is, the microcomputer 130 may be an example of the control device. In the description below, it may be assumed that the switch gear 51 (see FIGS. 5B and 5C) may be configured to move between the engaged position where the switch gear 51 may be in engagement with the second gear 75 (e.g., the position depicted in FIG. 58) and the neutral position where the switch gear 51 might not be in engagement with the second gear 75 (e.g., the position depicted in FIG. 5C), in accordance with a dedicated actuator controlled by the microcomputer 130. An initial position of the switch gear 51 may be the engaged position (e.g., the position depicted in FIG. 5B).

The microcomputer 130 may control image recording on a recording sheet 12 described below. That is, a length L1 along the conveyance direction 15 (see FIG. 8A) of a recording sheet 12 subject to image recording may be longer than a length L2 (see FIG. 8B). The length L1 may refer to a length along the front-rear direction 8 of a recording sheet 12 while the recording sheet 12 is placed on the feed tray 20. For example, the length L1 may be obtained based on the amount of rotation of the conveyor roller 60 between when a leading edge of the recording sheet 12 being conveyed in the conveyance direction 15 is detected by the detector 160 and when a trailing edge of the recording sheet 12 is detected by the detector 160. In other embodiments, for example, the microcomputer 130 may recognize the length L1 using another method, instead of the above-described method of obtaining the length L1 based on the detection of the edges of the recording sheet 12 by the detector 160 and the amount of rotation of the conveyor roller 60. For example, the microcomputer 130 may recognize the length based on a size of a recording sheet 12 specified by a user who may operate an operation panel 17 (see FIG. 1) before printing.

The length L2 may refer to a length of a conveyance path that may start from a nip line comprising the plurality of nip points of the reversible roller pairs 43 and return to the same nip line while running through the second conveyance path 67 from the first junction 36 to the second junction 37 and further running through the first conveyance path 65 from the second junction 37 to the nip line comprising the nip points of the reversible roller pairs 43. The length L2 may be a design value determined based on the lengths of the first conveyance path 65 and the second conveyance path 67 in the multifunction device 10, the locations of the first junction 36 and the second junction 37, and the disposed location of the reversible roller pairs 43.

For example, when double-sided printing is instructed through an operation performed on the operation panel 17 (see FIG. 1), the microcomputer 130 may move the switch gear 51 from the neutral position to the engaged position where the switch gear 51 may engage the second gear 75 using one of the above-described methods. While the switch gear 51 is in engagement with the second gear 75, a drive force of the conveyor motor 71 may be transmitted to the feed roller 25. Then, the microcomputer 130 may start rotating the conveyor motor 71 in the reverse direction (e.g., step S10). Thus, the feed roller 25 may start rotating. As the conveyor motor 71 starts rotating in the reverse direction e.g., step S10), the conveyor roller 60, the discharge rollers 62, and the reversible rollers 45 may start rotating in the first rotational direction, that is, in the direction that may convey a recording sheet 12 in the direction reverse to the conveyance direction 15. With the rotation of the feed roller 25, one or more recording sheets 12 placed on the feed tray 20 may be fed, one by one, into the first conveyance path 65 (e.g., step S20).

As a leading edge (a downstream edge in the conveyance direction 15) of the recording sheet 12 being conveyed reaches the detector 160, the microcomputer 130 may determine that the leading edge has reached the disposed position of the detector 160 (e.g., step S30). The microcomputer 130 may determine that the leading edge of the recording sheet 12 being conveyed in the conveyance direction 15 has reached the conveyor roller pair 59, based on the rotation of the feed roller 25 by a predetermined amount after the recording sheet 12 was detected by the detector 160.

The microcomputer 130 may continue to rotate the conveyor roller 60 in the first rotational direction for a predetermined time period after the leading edge of the recording sheet 12 being conveyed in the conveyance direction 15 has contacted the conveyor roller 60. That is, the microcomputer 130 may perform an operation of correcting a skewing of the recording sheet 12 that may be in contact with the conveyor roller 60, which may be called a registration process (e.g., step S40). After the registration process, the microcomputer 130 may stop rotating the conveyor motor 71. Thereafter, the microcomputer 130 may move the switch gear 51 from the engaged position to the neutral position. Thus, a drive force of the conveyor motor 71 might not be transmitted to the feed roller 25 unless the switch gear 51 moves from the neutral position to the engaged position (e.g., step S50). Then, the microcomputer 130 may rotate the conveyor motor 71 in the normal direction (e.g., step S60). Thus, the conveyor roller 60 may convey the recording sheet 12 in the conveyance direction 15, and therefore, the recording sheet 12 may be formed into the continuous corrugated shape in the right-left direction 9 by the pressing portions 100 and the first support ribs 101.

Next, the microcomputer 130 may perform a start finding process in which a print start position may be found on the recording sheet 12 whose first surface (e.g., front surface) is subject to printing (e.g., step S70). More specifically, the microcomputer 130 may stop rotating the conveyor motor 71 when the leading edge of the recording sheet 12 being conveyed in the conveyance direction 15 reaches the print start position where the leading edge of the recording sheet 12 may face the recording unit 24. Thus, the rotation of the conveyor roller 60 may be stopped and the conveyance of the recording sheet 12 may also be stopped. The print start position may refer to, for example, a position at which the leading edge of the recording sheet 12 that may be present in an image recording area may face one or more nozzles 39, which may be defined in an upstream end portion of the recording head 38 in the conveyance direction 15, of the plurality of nozzles 39 defined in the recording head 38.

When the start finding process (e.g., step S70) is completed, the microcomputer 130 may perform image recording on the first surface of the recording sheet 12 (e.g., step S80). More specifically, the microcomputer 130 may alternately perform a process of ejecting ink droplets, from the one or more nozzles 39, onto the recording sheet 12 supported by the platen 42 while reciprocating the carriage 40 in the right-left direction 9 by controlling the recording unit 24 and a process of conveying the recording sheet 12 in the conveyance direction 15 by a predetermined line feed by controlling the conveyor roller 60.

After the image recording is completed, the microcomputer 130 may rotate the conveyor motor 71 in the normal direction to rotate the conveyor roller 60, the discharge rollers 62, and the reversible rollers 45 in the second rotational direction for conveying the recording sheet 12 in the conveyance direction 15. Thus, the recording sheet 12 may be further conveyed downstream in the conveyance direction 15. As a result, the recording sheet 12 may be formed into the continuous corrugated shape in the right-left direction 9 by the discharge roller pairs 66 and the pressing spurs 102 nipping the recording sheet 12 therebetween. The recording sheet 12 may be formed into the continuous corrugated shape in the right-left direction 9 also by the pressing spurs 102 and the second support ribs 103.

As described above, the continuous corrugated shape formed in the right-left direction 9 in the recording sheet 12 may increase stiffness of the recording sheet 12. Thus, the leading edge of the recording sheet 12 may be guided to the reversible roller pairs 43 appropriately without downward deformation.

The recording sheet 12 being nipped by the reversible roller pairs 43 may be formed into the continuous corrugated shape in the right-left direction 9 by the pressing spurs 104 and the reversible roller pairs 43.

When the leading edge of the recording sheet 12 being conveyed in the conveyance direction 15 reaches the path switching member 141, the path switching member 141 may be raised by the recording sheet 12 and thus move from the sheet-reverse position to the sheet-discharge position. Under this state, the reversible rollers 45 may be rotating in the second rotational direction. Therefore, the recording sheet 12 may be continuously conveyed toward the discharge tray 21. Thereafter, when the microcomputer 130 determines that the trailing edge (e.g., an upstream edge of the recording sheet 12 in the conveyance direction 15) of the recording sheet 12 being conveyed in the conveyance direction 15 has reached a specified position between the auxiliary roller 47 and the auxiliary roller 48, that is, the first junction 36, the microcomputer 130 may stop rotating the conveyor motor 71 (e.g., step S90). When the trailing edge of the recording sheet 12 reaches the specified position, a force of the path switching member 141 resulting from its own weight may become greater than the force of the recording sheet 12 raising the path switching member 141 upward. Therefore, the path switching member 141 may move from the sheet-discharge position to the sheet-reverse position. Accordingly, the trailing edge of the recording sheet 12 being conveyed in the conveyance direction 15 may be depressed by the auxiliary roller 48 and thus the direction in which the trailing edge of the recording sheet 12 points may be changed toward the second conveyance path 67.

Then, the microcomputer 130 may rotate the conveyor motor 71 in the reverse direction (e.g., step S100). Thus, the conveyor roller 60, the discharge rollers 62, and the reversible rollers 45 may rotate in the first rotational direction.

By performance of the processing of step S100, the conveyance direction of the recording sheet 12 may become almost reverse to the conveyance direction 15, and the recording sheet 12 in which the upstream edge in the conveyance direction 15 may point toward the second conveyance path 67 may be turned back and conveyed into the second conveyance path 67. The recording sheet 12 that has been turned back may be then conveyed in the conveyance direction 16 that may extend toward the second junction 37 from the first junction 36 through the second conveyance path 67. Thereafter, the leading edge and the trailing edge of the recording sheet 12 may be reversed between when the recording sheet 12 is conveyed for recording on the first surface (e.g., the front surface) thereof and when the recording sheet 12 is conveyed after being turned back. That is, the trailing edge (e.g., the upstream edge in the conveyance direction 15) of the recording sheet 12 when an image is recorded on the first surface (e.g., the front surface) thereof may be the leading edge of the recording sheet 12 when the recording sheet 12 is conveyed after being turned back, and the leading edge (e.g., the downstream edge in the conveyance direction 15) of the recording sheet 12 when an image is recorded on the first surface (e.g., the front surface) thereof may become the trailing edge of the recording sheet 12 when the recording sheet 12 is conveyed after being turned back.

When the leading edge of the recording sheet 12 conveyed in the first conveyance path 65 again from the second junction 37 after the recording sheet 12 turned back reaches the detector 160, the leading edge may be detected by the detector 160

(e.g., step S110). Thereafter, similar to the processing of step S40, the microcomputer 130 may perform the registration process (e.g., step S120), and change the rotational direction of the conveyor motor 71 from the reverse direction to the normal direction similar to the processing of step S60 (e.g., step S130). That is, the microcomputer 130 may rotate the conveyor motor 71 in the normal direction to convey the recording sheet 12 downstream in the conveyance direction 15 on a condition that the leading edge of the recording sheet 12, which may be conveyed into the first conveyance path 65 again via the second conveyance path 67, has been located at the nip points of the recording sheet 12 by the conveyor roller pair 59. When the recording sheet 12 is conveyed downstream in the conveyance direction 15 from the conveyor roller pair 59, the recording sheet 12 may be formed into the continuous corrugated shape in the right-left direction 9 by the pressing portions 100 and the first support ribs 101, in a similar manner to the processing of step S60.

In step S130, when the rotational direction of the conveyor motor 71 is changed from the reverse direction to the normal direction and thus the conveyor roller 60, the discharge rollers 62, and the reversible rollers 45 rotate in the second rotational direction, the conveyor roller pair 59 and the reversible roller pairs 43 may both nip the same recording sheet 12 and may pull the recording sheet 12 between each other. Thus, as described above, it may be determined that the conveyance force of the conveyor roller pair 59 may be greater than the conveyance force of the reversible roller pairs 43. The conveyance force may refer to a force that one or more roller pairs may convey a recording sheet 12. For example, the conveyance force may be determined based on, for example, the rotating speed or material of the roller constituting each of the roller pairs or the nipping force of each of the roller pairs. With the above-determination, the three that the conveyor roller pair 59 may convey the recording sheet 12 may become greater than the force that reversible roller pairs 43 may convey the recording sheet 12. Therefore, the conveyor roller pair 59 may pull out the recording sheet 12 from the reversible roller pairs 43 and convey the recording sheet 12.

Subsequently, in a similar manner to the manner performed when an image is recorded on the first surface of the recording sheet 12, the microcomputer 130 may convey the recording sheet 12 to the print start position (e.g., step S140) and record an image on a second surface of the recording sheet 12 (e.g., step S150). The second surface may be a back side of the first surface. Thereafter, the microcomputer 130 may rotate the conveyor motor 71 in the normal direction to rotate the conveyor roller 60, the discharge rollers 62, and the reversible rollers 45 in the second rotational direction for conveying the recording sheet 12 in the conveyance direction 15.

Therefore, as is the case after the image is recorded on the first surface of the recording sheet 12, the recording sheet 12 may be conveyed downstream in the conveyance direction 15 from the position right below the recording unit 24 and thus the recording sheet 12 may be formed into the continuous corrugated shape in the right-left direction 9 by the discharge roller pairs 66 and the pressing spurs 102 nipping the recording sheet 12 therebetween. The recording sheet 12 may be formed into the continuous corrugated shape in the right-left direction 9 also by the pressing spurs 102 and the second support ribs 103.

As described above, the continuous corrugated shape formed in the right-left direction 9 in the recording sheet 12 may increase stiffness of the recording sheet 12. Thus, the leading edge of the recording sheet 12 in which an image has been recorded on the second surface may be guided to the reversible roller pairs 43 without deforming downward, as in the case where the leading edge of the recording sheet 12 in which the image has been recorded on the first surface may be guided to the reversible roller pairs 43.

The recording sheet 12 nipped by the reversible roller pairs 43 may be formed into the continuous corrugated shape in the right-left direction 9 by the pressing spurs 104 and the reversible roller pairs 43.

Thereafter, the microcomputer 130 may rotate the conveyor motor 70 to further convey the recording sheet 12 in the conveyance direction 15. Then, the recording sheet 12 may pass the reversible roller pairs 43 and reach a position downstream of the reversible roller pairs 43 in the conveyance direction 115. Thus, the recording sheet 12 may be discharged onto the discharge tray 21 (e.g., step S160).

The recording sheet 12 being conveyed in the first conveyance path 65 may be formed into the corrugated shape in the right-left direction 9 by the corrugate mechanisms 90A and 90B. The corrugated shape formed in the recording sheet 12 may increase stiffness of the recording sheet 12. Thus, the recording sheet 12 may be conveyed appropriately while its leading edge points toward the reversible roller pairs 43. That is, without the reversible roller 45 and the spur 64 being separated from each other in each of the reversible roller pairs 43 for guiding the recording sheet 12 into the second conveyance path 67, the leading edge of the recording sheet 12 may be guided to the reversible roller pairs 43 nipping the trailing edge portion of the recording sheet 12 and the recording sheet 12 may be pinched by the reversible roller pairs 43 appropriately.

The lower side of the recording sheet 12 being conveyed in the first conveyance path 65 may be supported by the first support ribs 101 and the second support ribs 103, and the upper side of the recording sheet 12 may be pressed by the pressing portions 100 and the pressing spurs 102 and 104. By doing so, the recording sheet 12 may be formed into the corrugated shape in the right-left direction 9.

The pressing spurs 102 and the second support ribs 103 may be disposed downstream of the nozzles 39 in the conveyance direction 15 and upstream of the reversible roller pairs 43 in the conveyance direction 15. Therefore, the recording sheet 12 may be formed into the corrugated shape in the right-left direction 9 at the position downstream of the nozzles 39 in the conveyance direction 15 and upstream of the reversible roller pairs 43 in the conveyance direction 15. Accordingly, stiffness of the recording sheet 12 on which an image has been recorded by the recording unit 24 may be increased by the corrugate mechanism 90B, whereby the reversible roller pairs 43 may pinch the recording sheet 12 easily.

A plurality of pressing members may press a recording sheet 12 from above and a plurality of support members may support the recording sheet 12 from below may be disposed in the conveyance direction 15. This configuration may increase stiffness of the recording sheet 12.

The recording sheet 12 may be formed into the corrugated shape in the right-left direction 9 by the pressing spurs 102 and the discharge roller pairs 66. With this configuration, the recording sheet 12 may be conveyed to the reversible roller pairs 43 without the corrugated shape formed in the right-left direction 9 in the recording sheet 12 being deformed.

The force that the discharge roller pairs 66 may convey to the recording sheet 12 by nipping the recording sheet 12 therebetween may be greater than the force that reversible roller pairs 43 may convey to the recording sheet 12 by nipping the recording sheet 12 therebetween. Therefore, according to the embodiment, the leading edge of the recording sheet 12 that may be conveyed by the discharge roller pairs 66 in the conveyance direction and reach the reversible roller pairs 43 may be thrust into the nip points of the reversible roller pairs 43. Even when the trailing edge portion of the recording sheet 12 is still nipped by the reversible roller pairs 43 when the leading edge of the recording sheet 12 is nipped by the discharge roller pairs 66, the trailing edge of the recording sheet 12 may be pulled out from the reversible roller pairs 43 easily.

The recording sheet 12 being conveyed in the first conveyance path 65 may be nipped by the discharge roller pairs 66 at the predetermined vertical position. Portions of the recording sheet 12 may be located at the position lower than the predetermined vertical position by the pressing spurs 102 pressing the recording sheet 12 between the respective pairs of the discharge roller pairs 66 in the right-left direction 9. Therefore, the recording sheet 12 may be formed into the corrugated shape in the right-left direction 9.

The force that the conveyor roller pair 59 may convey to the recording sheet 12 by nipping the recording sheet 12 therebetween may be greater than the force that the reversible roller pairs 43 may convey to the recording sheet 12 by nipping the recording sheet 12 therebetween. Therefore, even when the trailing edge portion of the recording sheet 12 is still nipped by the reversible roller pairs 43 when the leading edge of the recording sheet 12 is nipped by the conveyor roller pair 59 after the recording sheet 12 passes the second conveyance path 67, the trailing edge of the recording sheet 12 may be pulled out from the reversible roller pairs 43 easily and the recording sheet 12 may be further conveyed appropriately.

The conveyor motor 71 may be rotated in the normal direction after the leading edge of the recording sheet 12 that has been conveyed in the second conveyance path 67 reaches the nip points of the recording sheet 12 by the conveyor roller pair 59. Therefore, the recording sheet 12 may be conveyed in the conveyance direction 15 by the conveyor roller pair 59. That is, even when the conveyor roller 60 and the reversible rollers 45 are driven by the common conveyor motor 71, the recording sheet 12 on which an image has been recorded on the first surface thereof may be conveyed toward the second conveyance path 67 by the reversible roller pairs 43, the recording sheet 12 that has reached the conveyor roller pair 59 from the second conveyance path 67 may be further conveyed to the recording unit 24 by the conveyor roller pair 59, and the recording sheet 12 on which another image has been recorded on the second surface thereof by the recording unit 24 may be guided to the reversible roller pairs 43 again.

In the above-described embodiment, the corrugate mechanism 90A may be disposed upstream of the nozzles 39 in the conveyance direction 15 and the corrugate mechanism 90B may be disposed downstream of the nozzles 39 in the conveyance direction 15. Nevertheless, in an alternative configuration, the corrugate mechanism 90B may be disposed downstream of the nozzles 39 in the conveyance direction 15 only. For example, the printer unit 11 might not comprise the first corrugate mechanism 90A comprising the pressing portions 100 and the first support ribs 101. That is, in the alternative configuration, it may be necessary only that at least the corrugate mechanism 90B comprising the contact portion (e.g., the pressing spurs 102) and the protrusion (e.g., the second support ribs 103) may be disposed downstream of the nozzles 39 in the conveyance direction 15 and upstream of the reversible roller pairs 43 in the conveyance direction 15.

In this alternative configuration, the corrugate mechanism 90B may be disposed downstream of the nozzles 39 in the conveyance direction 15 and upstream of the reversible roller pairs 43 in the conveyance direction 15 only. Nevertheless, in another alternative configuration, the corrugate mechanism 90A may be disposed upstream of the nozzles 39 in the conveyance direction 15 only.

In the above-described embodiment, the recording sheet 12 may be pressed by the pressing portions 100 at the position upstream of the nozzles 39 in the conveyance direction 15 and may be pressed by the pressing spurs 102 and 104 at the position downstream of the nozzles 39 in the conveyance direction 15. Nevertheless, the configuration for pressing the recording sheet 12 might not be limited to the above-described configuration.

For example, in yet another configuration, the recording sheet 12 may be pressed by pressing spurs at a position upstream of the nozzles 39 in the conveyance direction 15 and may be pressed by pressing portions 100 at a position downstream of the nozzles 39 in the conveyance direction 15.

In another example, the printer unit 11 might not comprise the pressing spurs 102 and 104, and the recording sheet 12 may be formed into the corrugated shape in the right-left direction 9 by the pressing portions 100 and the support ribs 101 at at least one position of the position upstream of the nozzles 39 in the conveyance direction 15 and the position downstream of the nozzles 39 in the conveyance direction 15.

In another example, instead of the above configuration in the yet another configuration, the printer unit 11 might not comprise the pressing portions 100, and the recording sheet 12 may be formed into the corrugated shape in the right-left direction 9 by the pressing spurs 102 and 104 and the support ribs 103 and/or one or more roller pairs 59 and 66 at at least one position of the position upstream of the nozzles 39 in the conveyance direction 15 and the position downstream of the nozzles 39 in the conveyance direction 15.

In the above-described embodiment, the recording sheet 12 may be formed into the corrugated shape in the right-left direction 9 by the discharge roller pairs 66 and the pressing spurs 102 and by the reversible roller pairs 43 and the pressing spurs 104. Nevertheless, in another example, the recording sheet 12 may be formed into the corrugated shape in the right-left direction 9 by the conveyor roller pair 59 and the pressing spurs 102 and 104.

According to still yet another configuration, the positional relationship among the pressing portions 100, the pressing spurs 102 and 104, the discharge roller pairs 66, the reversible roller pairs 43, the first support ribs 101, and the second support ribs 103 in the conveyance direction 15 might not be limited to the positional relationships described herein, as long as the function of forming the recording sheet 12 into the corrugated shape in the right-left direction 9 is retained. In the still yet another configuration, the pressing spurs 102 may be disposed downstream of the discharge roller pairs 66 in the conveyance direction 15. Nevertheless, in the still yet another configuration, for example, the pressing spurs 102 may be disposed upstream of the discharge roller pairs 66 in the conveyance direction 15.

As shown in FIG. 9, in the double-sided image recording process performed on a recording sheet 12, the microcomputer 130 may stop the conveyance of the recording sheet 12 for a predetermined time period on a condition that a leading edge of the recording sheet 12, which may be conveyed by the conveyor roller pair 59 toward the reversible roller pairs 43 after the first surface of the recording sheet 12 is recorded with an image by the recording unit 24, is located downstream of the pressing spurs 102 in the conveyance direction 15 and upstream of the reversible roller pairs 43 in the conveyance direction 15.

Hereinafter, a procedure of a double-sided image recording process to be performed on a recording sheet 12 by the microcomputer 130 is described with reference to a flowchart depicted in FIG. 9. In the description below, a detailed description is given for the different processing (e.g., steps enclosed by a dashed line in FIG. 9) of the processing performed in the process according to FIG. 9, and a description is omitted or is given briefly for the same processing (e.g., steps enclosed by a solid line in FIG. 9).

The microcomputer 130 may perform the start finding process for recording an image on the second surface of the recording sheet 12 whose first surface has been recorded with an image (e.g., step S80) and that has been conveyed in the second conveyance path 67 (e.g., step S140). Then, the microcomputer 130 may determine whether the leading edge (e.g., the downstream edge) of the recording sheet 12 being conveyed by the conveyor roller pair 59 in the conveyance direction 15 toward the reversible roller pairs 43 is located at the print start position (e.g., step S400).

When the microcomputer 130 determines that the leading edge (e.g., the downstream edge) of the recording sheet 12 being conveyed in the conveyance direction 15 has reached the print start position (e.g., YES in step S400), the microcomputer 130 may stop rotating the conveyor motor 71 (e.g., step S410). Thus, the conveyor roller 60, the discharge rollers 62, and the reversible rollers 45 may stop rotating and, therefore, the conveyance of the recording sheet 12 may be stopped.

Next, in step S410, the microcomputer 130 may determine whether the predetermined time period has elapsed since the conveyance of the recording sheet 12 was stopped (e.g., step S420). The predetermined time period may be a time required for ink that adheres to a recording sheet 12 by ink ejection of the recording unit 24 to dry to a desired state. The leading edge portion of the recording sheet 12 may dry in the corrugated shape formed by a corrugate mechanism 90D (e.g., the pressing portions 100) after the predetermined time period, resulting in the leading edge portion of the recording sheet 12 may having the corrugated shape. The microcomputer 130 may comprise a timer circuit and perform a determination in step S420 based on a count value of the timer circuit.

When the microcomputer 130 determines that the predetermined time period has elapsed (e.g., YES in step S420), the microcomputer 130 may rotate the conveyor motor 71 in the normal direction (e.g., step S430). Thus, the conveyor roller 60 may start the conveyance of the recording sheet 12 in the conveyance direction 15. Then, an image may be recorded on the second surface of the recording sheet 12.

During image recording (e.g., step S150) on the second surface of the recording sheet 12, the microcomputer 130 may suspend the image recording and perform processing (e.g., steps S440 to S460) that may be similar to the processing steps S400, S410, and S420 described above. That is, on a condition that the leading edge of the recording sheet 12, on which an image is being recorded on the second surface by the recording unit 24 (e.g., step S150), reaches a predetermined position (e.g., YES in step S440), the microcomputer 130 may suspend the current image recording and stop the conveyance of the recording sheet 12 for the predetermined time period (e.g., steps S450 and S460). The predetermined position may be located downstream of the pressing spurs 102 in the conveyance direction 15 and upstream of the reversible roller pairs 43 in the conveyance direction. After the predetermined time period has elapsed, the microcomputer 130 may restart the image recording on the second surface of the recording sheet 12 (e.g., step S470).

The conveyance of the recording sheet 12 may be stopped for the predetermined time period in both the situation after the leading edge of the recording sheet 12 reaches the print start position for recording an image onto the second surface (e.g., YES in step S400) and the situation after image recording on the second surface of the recording sheet 12 may be started (e.g., step S150). Nevertheless, in other embodiments, for example, the conveyance of the recording sheet 12 may be stopped for the predetermined time period in at least one of the situation after the positive determination is made in step S400 (e.g., YES in step S400) and the situation after the processing of step S150 is performed.

According to the procedure of FIG. 9, the corrugated shape formed in the recording sheet 12 in the right-left direction 9 may be maintained by the corrugate mechanism 90D for the predetermined time period. Thus, the leading edge portion of the recording sheet 12 may have the corrugated shape. Therefore, deformation of the recording sheet 12 caused by the ink adhesion may be alleviated. The recording sheet 12 may be nipped by the discharge roller pairs 66 and pressed by the pressing spurs 102, whereby the corrugated shape formed in the recording sheet 12 in the right-left direction 9 may be maintained for the predetermined time period. Accordingly, the leading edge portion of the recording sheet 12 may have the corrugated shape. Therefore, deformation of the recording sheet 12 caused by the ink adhesion may be alleviated. Further, stiffness of the recording sheet 12 on which one or more images have been recorded by the recording unit 24 may be increased. As a result, the reversible roller pairs 43 may easily pinch the recording sheet 12.

As depicted in FIG. 2, the second conveyance path 67 may branch off from the first conveyance path 65 at the first junction 36 located downstream of the discharge roller pairs 66 in the conveyance direction 15 and upstream of the reversible roller pairs 43 in the conveyance direction 15, and may join the first conveyance path 65 at the second junction 37 located upstream of the conveyor roller pair 59 in the conveyance direction 15. The second conveyance path 67 may be disposed with the Objective of turning a recording sheet 12 upside down to change its the surface facing the recording head 38 from one surface to the other surface. Therefore, as long as this objective is accomplished, the second conveyance path 67 might not be limited to the configuration depicted in FIG. 2.

Figure 10:
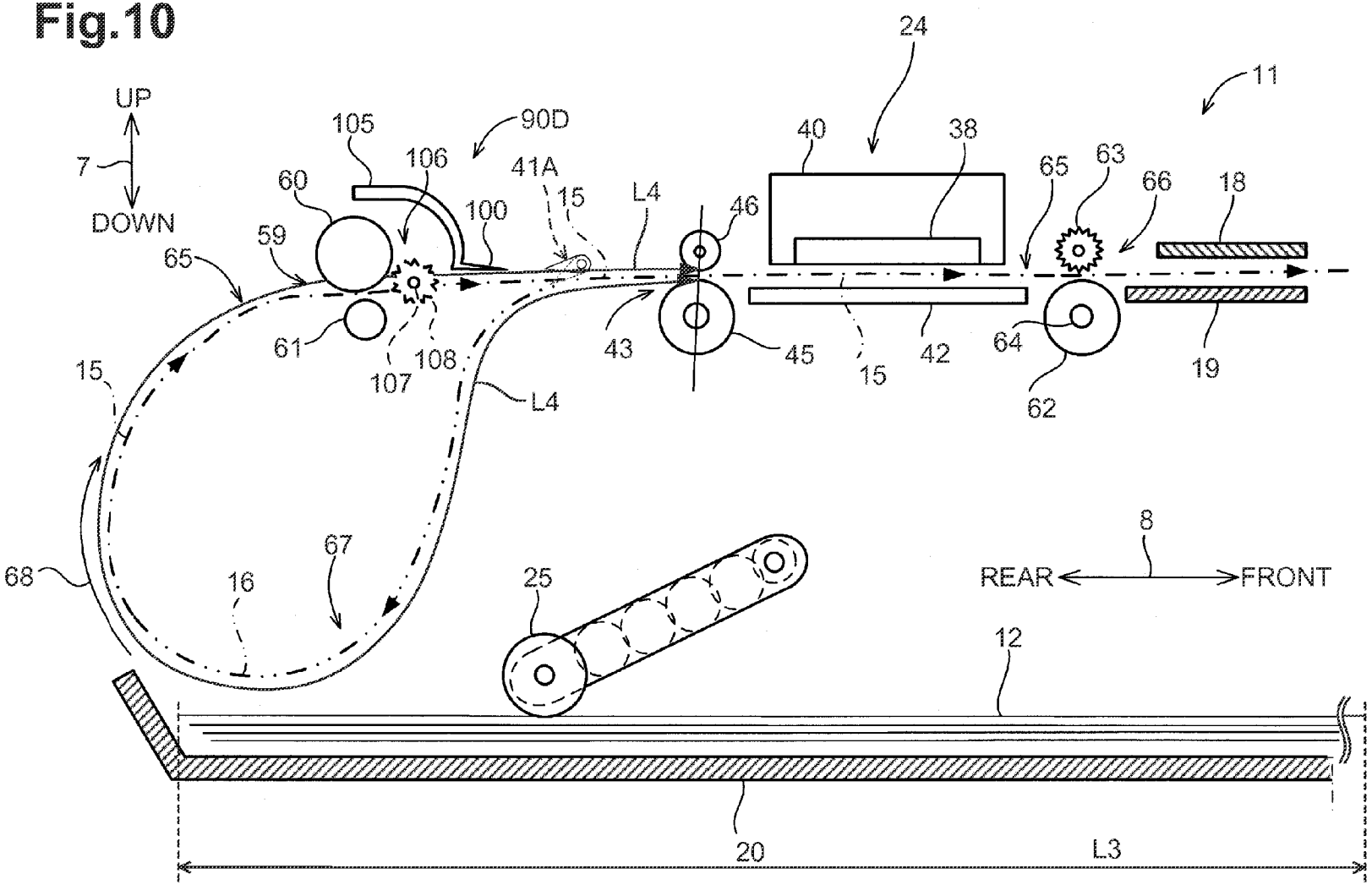
FIG. 10 is a schematic vertical sectional view depicting an internal configuration of the printer unit according to yet another embodiment of the invention.

For example, as depicted in FIG. 10, the reversible roller pairs 43 may be disposed between the conveyor roller pair 59 and the recording unit 24 in the first conveyance path 65, and the second conveyance path 67 may join the first conveyance path 65 at a junction located downstream of the conveyor roller pair 59 in the conveyance direction 15 and upstream of the reversible roller pairs 43 in the conveyance direction 15 and at a junction located upstream of the conveyor roller pair 59 in the conveyance direction 15. As shown in FIG. 10, a path switching member 41A may be disposed between the conveyor roller pair 59 and the reversible roller pairs 43 and above the first conveyance path 65. The path switching member 41A may be configured to be pivotable between a first position (e.g., a position indicated by a solid line in FIG. 10) and a second position (e.g., a position indicated by a dashed line in FIG. 10). The path switching member 41A may be driven by a drive source (not depicted) to switch its position between the first position and the second position. When the path switching member 41A is located in the first position, the path switching member 41A may allow a recording sheet 19 to pass under the path switching member 41A toward the recording unit 24. When the path switching member 41A is located in the second position, the path switching member 41A may guide a recording sheet 19 whose first surface has been recorded with an image into the second conveyance path 67. The path switching member 41A may be switched from the second position to the first position when the registration process is performed. Then, the path switching member 41A may allow the recording sheet 19 to pass under the path switching member 41A, and thus, an image may be recorded on a second surface of the recording sheet 19.

In the example depicted in FIG. 10, the pressing portions 100 as the corrugate mechanism 90D may be disposed downstream of the conveyor roller pair 59 in the conveyance direction 15 and upstream of the junction of the first conveyance path 65 and the second conveyance path 67. In the example depicted in FIG. 10, the first support ribs 101 might not be disposed on the platen 42. Instead, the first support ribs 101 as the corrugate mechanism 90D may be disposed on a guide member (e.g., the inside guide member 19) that may face the pressing portions 100 and may be configured to support a recording sheet 12 conveyed in the first conveyance path 65. In FIG. 10, the first support ribs 101 and the inside guide member 19 may be omitted. As described above, in the example depicted in FIG. 10, the corrugate mechanism 90D may be disposed upstream of the reversible roller pairs 43 in the conveyance direction 15.

The corrugate mechanism 90D disposed upstream of the junction in the first conveyance path 65 might not be limited to the pressing portions 100 and the first support ribs 101. For example, instead of the first support ribs 101, spurs 106 (indicated by a dashed line in FIG. 10) may be disposed downstream of the conveyor roller pair 59 in the conveyance direction 15. In the configuration of FIG. 10, a length L4 of the conveyance path that may correspond to the length L2 of the conveyance path may refer to a length of a conveyance path that may start from a nip line comprising the plurality of nip points of the reversible roller pairs 43, extend through the second conveyance path 67 from the second conveyance path 67 to the first conveyance path 65 and further through the first conveyance path 65 via the conveyor roller pair 59 and the pressing portions 100 of the corrugate mechanism 90D from the second conveyance path 67 to the nip line comprising the plurality of nip points of the reversible roller pairs 43, and return to the same nip line. The length L4 of the conveyance path may also be a design value similar to the length L2. A length L3 of a recording sheet 12 that may correspond to the length L1 of the recording sheet 12 may refer to a length along the front-rear direction 8 of a recording sheet 12 while the recording sheet 12 is placed on the feed tray 20. The length L3 of the recording sheet 12 may be slightly longer than the length L4 of the conveyance path. Therefore, the length L3 of the recording sheet 12 may be determined such that when the trailing edge of the recording sheet 12 whose first surface been recorded with an image by the recording unit 24 returns to the nip points of the reversible roller pairs 43 via the first conveyance path 65 from the second conveyance path 67, the leading edge portion of the recording sheet 12 is still nipped by the reversible roller pairs 43.

The above configuration is described in detail below. The spurs 106 may be spaced apart from each other in the right-left direction 9. Each of the spurs 106 may comprise a shaft 107 extending in the right-left direction 9 and a roller portion 108 disposed on the shaft 107. A peripheral surface of the roller portion 108 may have a spur shape. The shaft 107 may be rotatably supported by the frame (not depicted) of the printer unit 11. Each of the roller portions 108 may be disposed between the respective pairs of the adjacent pressing portions 100 in the right-left direction 9. The peripheral surfaces of the roller portions 108 of the spurs 106 may support a bottom surface of the recording sheet 12 being conveyed in the first conveyance path 65. For example, the peripheral surfaces of the roller potions 108 may contact the recording sheet 12 from below the recording sheet 12.

Upper ends of the roller portions 108 of the spurs 106 may be disposed higher than the lower ends of the pressing portions 100. With this configuration, the recording sheet 12 may be formed into the corrugated shape by the pressing portions 100 and the spurs 106. In this case, the pressing portions 100 and the spurs 106 may be an example of the corrugate mechanism.

In the example depicted in FIG. 10, one or more recording sheets 12 placed on the feed tray 20 may be guided to the conveyor roller pair 59 via a path indicated with an arrow 68. The recording sheet 12 may be conveyed from the conveyor roller pair 59 to the reversible roller pairs 43 and then further conveyed, by the reversible roller pairs 43, to the position where the recording sheet 12 may face the recording unit 24. At the position, an image may be recorded on the first surface of the recording sheet 12 by the recording unit 24. When the image recording is completed after an image is recorded on the first surface only, the recording sheet 12 may be discharged by the discharge roller pairs 66. When image recording is also performed on the second surface of the recording sheet 12 following the first surface, the recording sheet 12 may return to the reversible roller pairs 43 by the discharge roller pairs 66 while passing below the recording unit 24. Then, the recording sheet 12 may be turned back into the second conveyance path 67 by the reversible roller pairs 43 and then may be conveyed in the conveyance direction 16 (indicated by a double-dashed and dotted line in FIG. 10). When the leading edge of the recording sheet 12 reaches the conveyor roller pair 59, the recording sheet 12 may be conveyed in the conveyance direction 15 by the conveyor roller pair 59. At that time, the rotational direction of the reversible roller pairs 43 may be changed and thus the reversible roller pairs 43 may rotate in a direction that may convey the recording sheet 12 in the conveyance direction 15. At that time, both the conveyor roller pair 59 and the reversible roller pairs 43 may pull the recording sheet 12 between each other. Nevertheless, the drive force of the conveyor roller pair 59 may be greater than the drive force of the reversible roller pairs 43. Therefore, the recording sheet 12 may be conveyed in the conveyance direction 15. Therefore, the recording sheet 12 may be guided to the reversible roller pairs 43 again upside down in relation to the previous orientation (i.e., so that the second surface may be recorded with an image). While the recording sheet 12 is conveyed to the reversible roller pairs 43, the corrugate mechanism 90D and the recording sheet 12 may be in contact with each other. Therefore, the recording sheet 12 may be conveyed to a position downstream of the reversible roller pairs 43 in the conveyance direction 15. Then, the recording sheet 12 may be conveyed, by the reversible roller pairs 43, to the position where the recording sheet 12 may face the recording unit 24, and thus an image may be recorded on the second surface of the recording sheet 12 by the recording unit 24. Thereafter, the recording sheet 12 may be discharged by the discharge roller pairs 66.

The embodiment of FIG. 10 may be combined into one or more of the other embodiments (e.g., the above-described embodiment and/or one or more of the alternative configurations) within a feasible range while the arrangements of the second conveyance path 67 and the reversible roller pairs 43 described in the configuration depicted in FIG. 10 may be adopted.

What is claimed is:

1. An inkjet recording apparatus comprising:

a recording unit configured to eject ink droplets from nozzles to record an image onto a sheet;

a sheet-supply roller configured to supply and convey a sheet along a conveyance direction;

a first roller pair, disposed between the recording unit and the sheet supply roller along the conveyance direction, configured to convey the sheet to the recording unit along the conveyance direction at a first conveyance force while nipping the sheet therebetween at a first nip point;

a second roller pair, disposed downstream of the first roller pair in the conveyance direction, and configured to return back a single-side image recorded sheet to the first roller pair at a second conveyance force less than the first conveyance force while nipping the sheet therebetween at a second nip point without passing through the sheet-supply roller; and a corrugate mechanism, disposed between the first roller pair and the second roller pair, and configured to form the sheet into a corrugated shape in a direction perpendicular to the conveyance direction and parallel to a recording surface of the sheet such that the corrugated sheet is conveyed to the recording unit and the second roller pair.

2. The inkjet recording apparatus according to claim 1, wherein the corrugate mechanism is disposed at least one of upstream of the nozzles in the conveyance direction and downstream of the nozzles in the conveyance direction.

3. The inkjet recording apparatus according to claim 1, wherein a length of a conveyance path for a double-sided printing starting from a nip line of the second roller pair and returning to the nip line of the second roller pair, by way of the first roller pair, is less than a length of a recording sheet, along the conveyance direction, on a feed tray.

4. The inkjet recording apparatus according to claim 1, wherein the second roller pair is disposed downstream of the nozzles in the conveyance direction.

5. The inkjet recording apparatus according to claim 4, further comprising:

a third roller pair disposed downstream of the nozzles in the conveyance direction and upstream of the second roller pair in the conveyance direction and configured to convey the sheet along the conveyance direction while nipping the sheet therebetween.

6. An inkjet recording apparatus comprising:

a recording unit configured to eject ink droplets from nozzles to record an image onto a sheet;

a sheet-supply roller configured to supply and convey a sheet along a conveyance direction;

a first roller pair, disposed between the recording unit and the sheet supply roller along the conveyance direction, configured to convey the sheet to the recording unit along the conveyance direction at a first conveyance force while nipping the sheet therebetween at a first nip point;

a second roller pair, disposed downstream of the first roller pair in the conveyance direction, and configured to return back a single-side image recorded sheet to the first roller pair at a second conveyance force less than the first conveyance force while nipping the sheet therebetween at a second nip point without passing through the sheet-supply roller;

a corrugate mechanism, disposed between the first roller pair and the second roller pair, and configured to form the sheet into a corrugated shape in a direction perpendicular to the conveyance direction and parallel to a recording surface of the sheet; and a controller configured to operate the first roller pair and the second roller pair to convey the sheet, wherein the second roller pair is configured to return the single-side image recorded sheet to the first roller pair, and the first roller pair is configured to return the sheet to the second roller pair, and wherein the controller is configured to make the first roller pair return the sheet to the second roller pair so that a leading edge of the sheet enters the second nip point of the second roller pair by the first conveyance force on a condition that a rear-end portion of the sheet is still nipped at the first nip point when the leading edge of the sheet returns to the second roller pair from the first roller pair.

7. The inkjet recording apparatus according to claim 6, wherein the controller is further configured to stop the conveyance of the sheet for a predetermined time period on a condition that the leading edge of the single-side image recorded sheet conveyed by the second roller pair toward the first roller pair reaches the corrugate mechanism.

8. The inkjet recording apparatus according to claim 6, wherein the control device is further configured to stop the conveyance of the sheet for a predetermined time period on a condition that the leading edge of the sheet reaches the corrugate mechanism disposed between the nozzles and the second roller pair along the conveyance direction.

* * * * *